US006467412B1

(12) United States Patent
Tobe et al.

(10) Patent No.: US 6,467,412 B1
(45) Date of Patent: Oct. 22, 2002

(54) PRINTING PRESS

(75) Inventors: Kenji Tobe; Shinichi Fujishiro, both of Chiba (JP)

(73) Assignee: Komori Corporation, Tokyo (JP)

( * ) Notice: Subject to any disclaimer, the term of this patent is extended or adjusted under 35 U.S.C. 154(b) by 0 days.

(21) Appl. No.: 09/662,633

(22) Filed: Sep. 15, 2000

(30) Foreign Application Priority Data

Sep. 17, 1999 (JP) ..... 11-264013

(51) Int. Cl.[7] ..... B41F 5/00; B41F 21/00; B41L 47/14

(52) U.S. Cl. ..... 101/477; 101/216

(58) Field of Search ..... 101/477, 216

(56) References Cited

U.S. PATENT DOCUMENTS

| | | | | |
|---|---|---|---|---|
| 5,495,805 A | * | 3/1996 | Beisel et al. | 101/477 |
| 5,555,812 A | * | 9/1996 | Ruckmann et al. | 101/477 |
| 5,595,119 A | | 1/1997 | Hada et al. | |
| 5,701,822 A | * | 12/1997 | Metrope | 101/477 |
| 6,053,105 A | * | 4/2000 | Rudewitz | 101/477 |

FOREIGN PATENT DOCUMENTS

| | | |
|---|---|---|
| EP | 0734859 A | 10/1996 |
| JP | 7-217651 A | 8/1995 |

* cited by examiner

*Primary Examiner*—Andrew H. Hirshfeld
*Assistant Examiner*—Marvin P Crenshaw

(57) ABSTRACT

A printing press comprises a pair of left- and right-frames, a safety cover movably supported between a closing position for closing at least one part of a space formed between the frames and a releasing position for releasing the space and a printing plate holding device movably supported at an exterior side with respect to the safety cover between a shelter position for holding a new printing plate supplied to a lower plate cylinder and a discharged printing plate discharged from the lower plate cylinder and an operation position for storing the new printing plate supplied to the lower plate cylinder or the discharged printing plate discharged from the lower plate cylinder. While the safety cover at the closing portion, the printing plate holding device can be moved between the shelter position and the operation position in order to set a new printing plate and remove a discharged printing plate easily while a peripheral are of a lower side of a printing unit can be protected in the case of exchanging the printing plate.

15 Claims, 19 Drawing Sheets

140
110
101
11
160
12
14
15
13
240
210
203
200
260
201

PRINTING PRESS

BACKGROUND OF THE INVENTION

1. Field of the Invention

The present invention relates to a printing plate holding device for holding a new printing plate supplied to a plate cylinder of a printing press and a discharged printing plate discharged from the plate cylinder.

2. Prior Art

Regarding a conventional printing plate holding device for supplying a new printing plate to a plate cylinder of a printing press and a discharged printing plate discharged from the plate cylinder, it has been disclosed in Japanese Utility Model Registration No. 3032484 and Japanese Patent Laid-Open (Kokai) Publication No. 8-108525.

In a printing plate holding device disclosed in Japanese Utility Model Registration No. 3032484, an end portion of a printing plate discharged from a plate cylinder is engaged and supported by a lever elastically supported through a pre-load member. The discharged printing plate is stored and held in a frame for removing the discharged printing plate by moving the lever by an operation unit. On the other hand, a new printing plate can be supplied to a plate cylinder by pivotally releasing a hook member for holding a new printing plate in a frame for supplying a printing plate by an operation unit.

In a printing plate holding device disclosed in Japanese Patent Laid-Open (Kokai) Publication No. 8-108525, a new printing plate is set in a cassette for a new printing plate. An end of the new printing plate is engaged and supported by a claw member for supporting the end of the new printing plate. The claw member is moved toward a direction of supplying a printing plate by an air cylinder device for feeding the new printing plate. The new printing plate can be supplied to a plate cylinder by pivoting the claws with a cam member during moving the claw member so as to release an engagement and support of the end portion of the new printing plate.

In a printing plate holding device disclosed in Japanese Utility Model Registration No. 3032484, a discharged printing plate discharged from a plate cylinder is held by an energized lever in a frame for removing a discharged printing plate so that an operation for picking up the discharged printing plate from the frame for removing the discharged printing plate becomes complicated. An engagement of a new printing plate is released by pivoting a hook by an exclusive use operation unit so that number of parts is increased and a weight of the device becomes heavy. A manufacturing cost becomes high.

In the printing plate holding device disclosed in Japanese Patent Laid-Open (Kokai) Publication No. 8-108525, while the claws for supporting an end of the printing plate is operated, a new printing plate should be set in a cassette for a new printing plate. Setting operation for the new printing plate becomes complicated.

A purpose of the present invention is to provide a printing plate holding device for easily picking up a discharged printing plate and setting a new printing plate with a simple structure.

SUMMARY OF THE INVENTION

Figure 1:
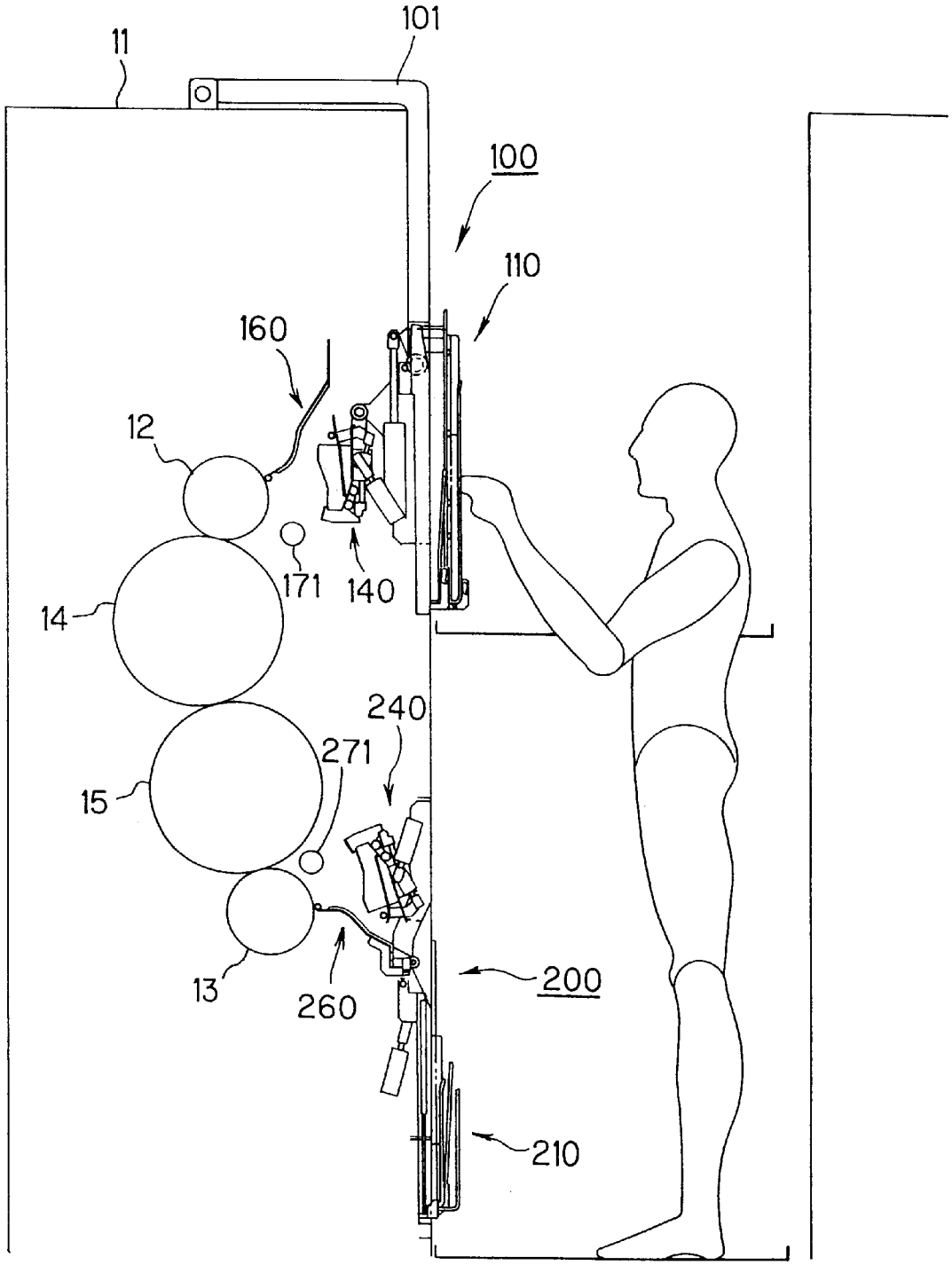
FIG. 1 shows a schematic view of an embodiment of a printing plate exchange device of a printing press according to the present invention.

To resolve the above described drawbacks, a device for holding a printing plate according to the present invention comprises printing plate storing means with a storing space, the storing space for storing a discharged printing plate discharged from a plate cylinder or a new printing plate supplied to the plate cylinder, and moving means for moving the printing plate storing means between an operation position for storing the printing plate discharged from the plate cylinder in the storing space or supplying to the printing plate from the storing space to the plate cylinder and a shelter position released from the plate cylinder, the device for holding the printing plate characterized of further comprising a printing plate holding member movable with respect to the printing plate storing means, wherein the printing plate holding member can engage with an end of the discharged printing plate by advancing to the storing space of the discharged printing plate storing means by moving to the operation position of the discharged printing plate storing means by the moving means and can be released from the storing space of the discharged printing plate storing means by moving to the shelter position of the discharged printing plate storing means by the moving means.

In the above device for holding a printing plate, the device characterized in that the printing plate storing means is discharged printing plate storing means with the storing space for storing a discharged printing plate discharged from the plate cylinder, the moving means moves the printing plate storing means between the operation position for storing the discharged printing plate discharged from the plate cylinder in the storing space and a shelter position released from the plate cylinder, the printing plate holding member is movable with respect to the discharged printing plate storing means, wherein the discharged printing plate holding member can engage with an end of the discharged printing plate by advancing to the storing space of the discharged printing plate storing means by moving to the operation position of the discharged printing plate storing means by the moving means and can be released from the storing space of the discharged printing plate storing means by moving to the shelter position of the discharged printing plate storing means by the moving means.

In the above device for holding a printing plate, the device characterized in that a downstream end of the storing space along a direction for storing the discharged printing plate is lower than an upstream end of the storing space in the case that the discharged printing plate storing means is in the shelter position, the discharged printing plate holding member is pivotally supported by the discharged printing plate storing means wherein the discharged printing plate holding member moves the discharged printing plate to a storing position for storing the discharged printing plate in the printing plate storing means and the discharged printing plate holding member is located at an upstream side along the direction for storing the discharged printing plate with respect to a downstream end portion of the storing space of the printing plate storing means in the case that the discharged printing plate holding member is in the storing position, and a length between a pivot point of the discharged printing plate holding member located at the storing position and the downstream end portion of the storing space of the discharged printing plate storing means is longer than a length between the pivot point of the discharged printing plate holding member and a front end portion of discharged printing plate holding member.

In the above described device for holding a printing plate, the device characterized of further comprising a pivot restricting member for restricting a pivot movement of the discharged printing plate holding member advanced in the storing space of the discharged printing plate storing means in the operation position toward the upstream side along the direction for storing the discharged printing plate.

In the above described device for holding a printing plate, the device is characterized in that the discharged printing plate can be pick up through a side portion of the storing space of the printing plate storing means.

In the above described device for holding a printing plate, wherein the printing plate storing means is a new printing plate storing means for storing the new printing plate supplied to a plate cylinder, the printing plate storing means having a storing space for storing the new printing plate, the moving means for moving the printing plate storing means between an operation position for supplying the new printing plate to the plate cylinder and a shelter position released from the plate cylinder, the printing plate holding member provided at the new printing plate storing means is a new printing plate holding member for holding the new printing plate in the storing space of the new printing plate storing means by engaging with an end portion of the new printing plate, and the device further comprises a releasing member provided at a downstream side along a direction for supplying the new printing plate with respect to an upstream side of a storing position of the storing space of the new printing plate storing means, the releasing member releasing the new printing plate holding member from the storing space of the new printing plate storing means by moving toward the downstream side along the direction for supplying the new printing plate of the new printing plate holding member, wherein the new printing plate holding member is movable with respect to the new printing plate storing means, the new printing plate holding member goes ahead into the storing space in order to engage with an end portion of the new printing plate in the case that the new printing plate storing means is moved to the operation position by the moving means and the new printing plate holding member is released from the storing space of the printing plate storing means in the case that the new printing plate storing means is moved to the shelter position by the moving means.

In the above described device for holding a new printing plate, the device characterized in that a downstream side of the storing space along the direction of storing the new printing plate is lower than an upstream side of the storing space in the case that the new printing plate storing means is in the shelter position, the new printing plate holding member is pivotally supported by the new printing plate storing means, in the case of the new printing plate located at the storing position, the new printing holding member is located at the downstream side of the storing space with respect to an upstream end side of the storing space of the new printing plate storing means along the direction for storing the new printing plate, and a length between a pivot point of the new printing plate holding member located at the storing position and an upstream end of the storing space of the printing plate storing means along the direction for storing the new printing plate is longer than a length between the pivot point and an front end of the holding member.

In the above described device for holding a printing plate, the device characterized of further comprising a contacting member for moving the new printing plate toward an downstream side along the direction for supplying the new printing plate by contacting with an end portion of the new printing plate by moving with the new printing plate holding member from the storing position of the storing space of the printing plate storing means toward the downstream side of the direction for supplying the new printing plate.

In the above described device for holding a printing plate, the device characterized of further comprising a pivot restricting member for restricting a pivot movement of the holding member toward the downstream side along the direction for storing the new printing plate under the condition that the holding member is advanced to the storing space in the case that the new printing plate storing means is in the operating position.

In the above device for holding a printing plate, the device is characterized in that the new printing plate can be inserted through a side portion of the storing space of the new printing plate storing means.

PREFERRED EMBODIMENTS OF THE PRESENT INVENTION

Figure 2:
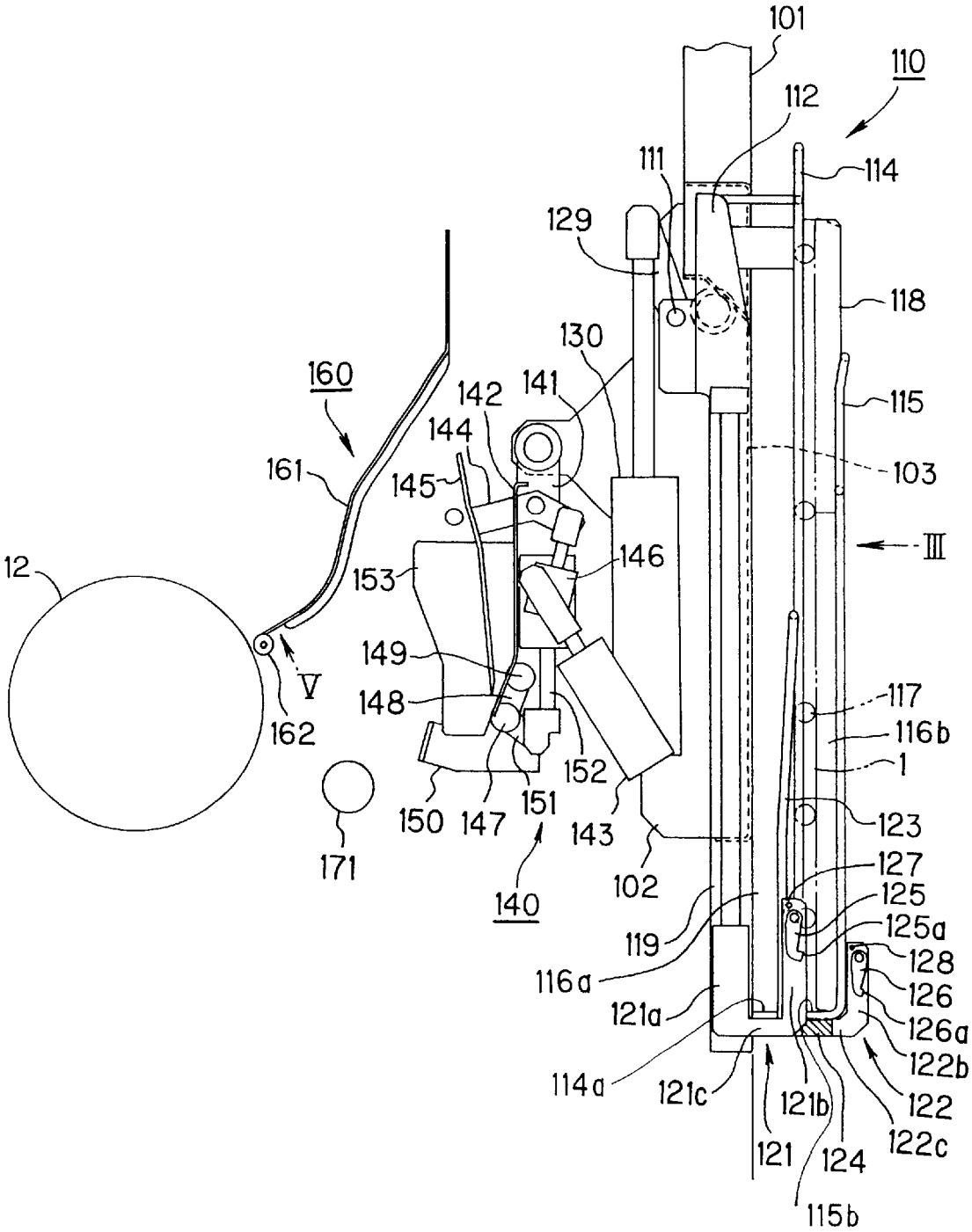
FIG. 2 shows a schematic view of an upper printing plate exchange device as shown in FIG. 1.
Figure 3:
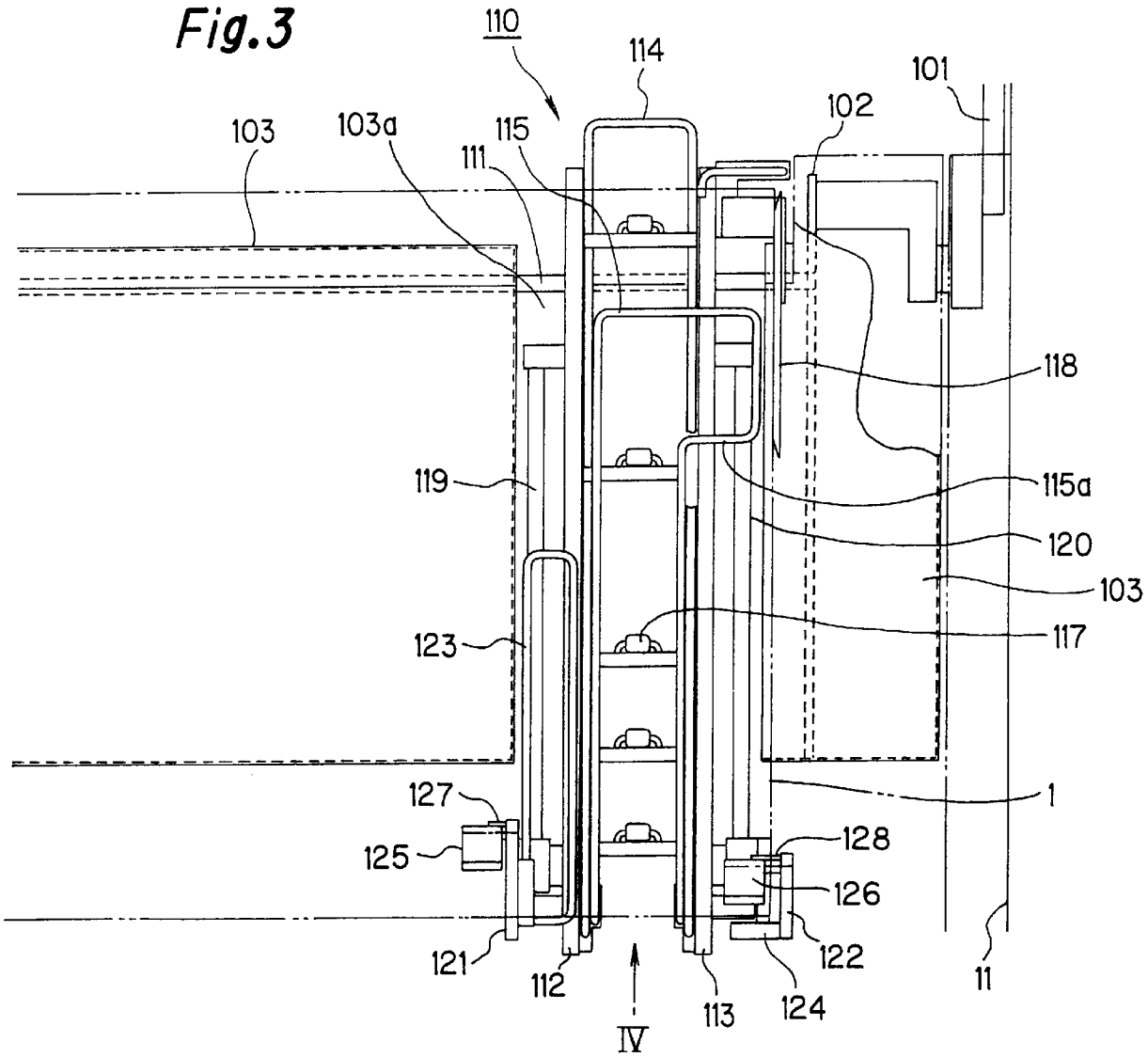
FIG. 3 shows a partially enlarged view of the device taken along a line III—III in FIG. 2.
Figure 4:
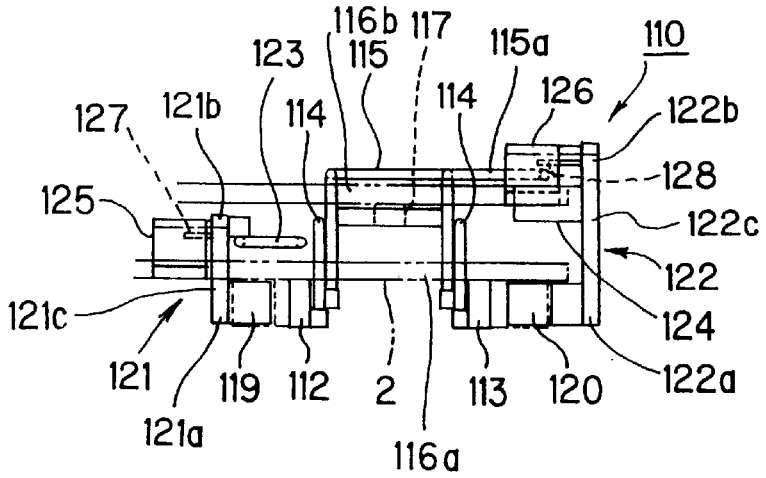
FIG. 4 shows a partially enlarged view of the device taken along a line IV—IV in FIG. 3.
Figure 5:
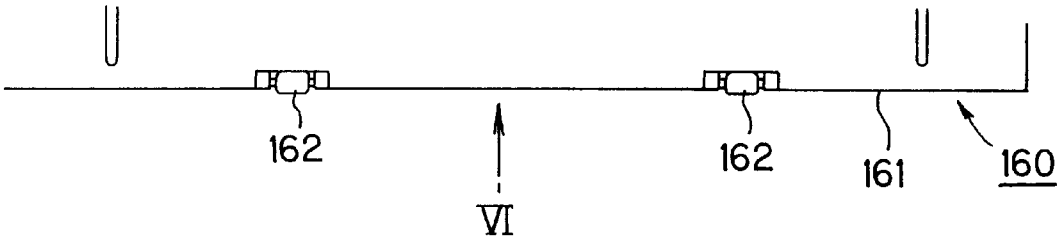
FIG. 5 shows a partially enlarged view of the device taken along a line V—V in FIG. 2.
Figure 6:
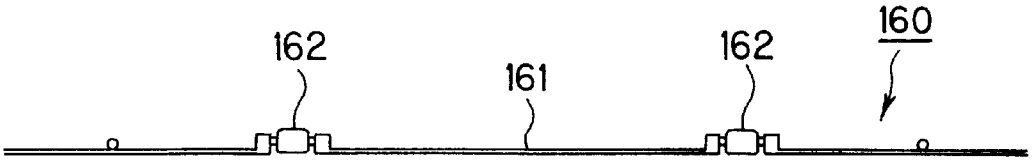
FIG. 6 shows a device taken along a line VI—VI in FIG. 5.
Figure 7:
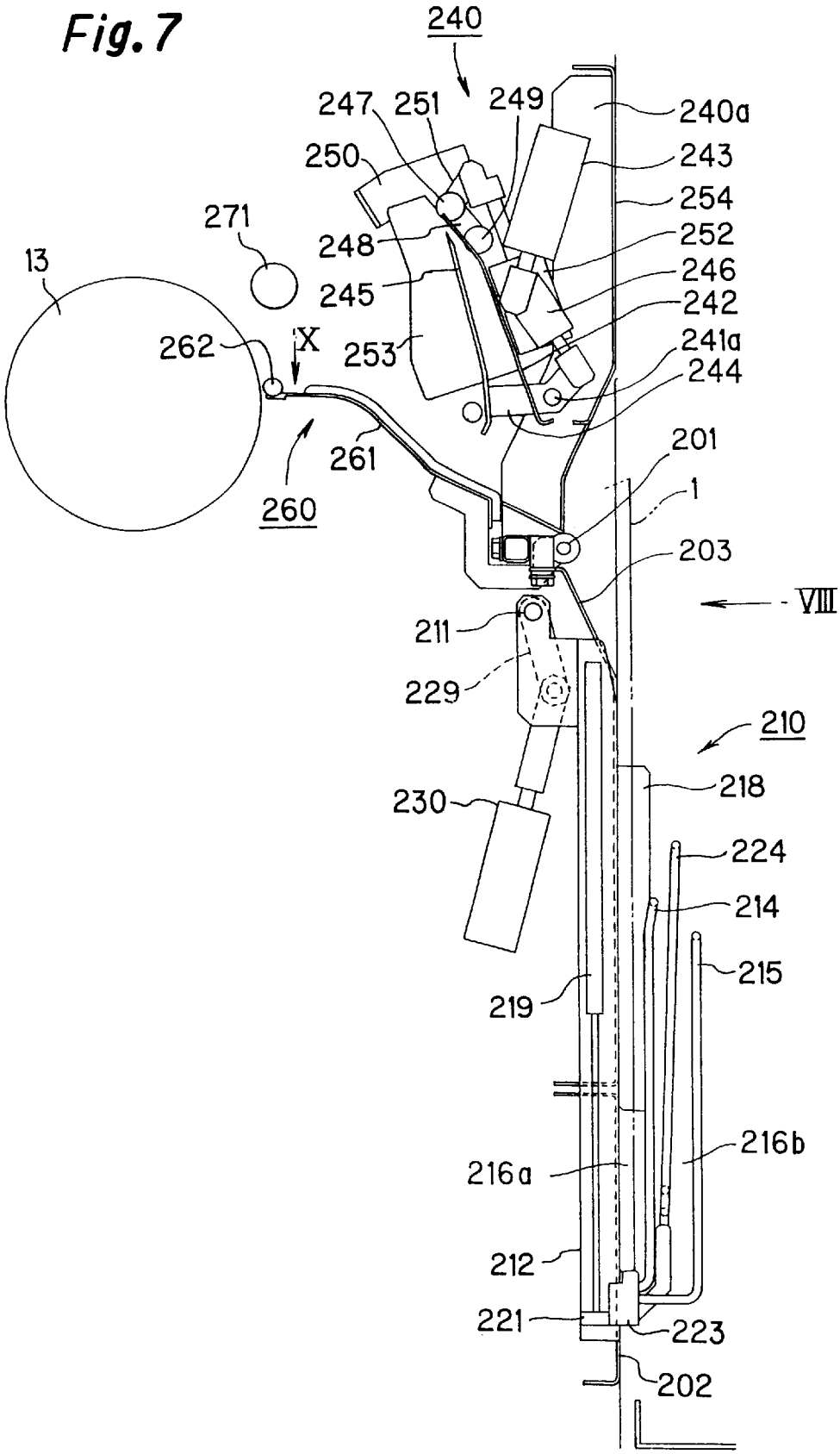
FIG. 7 shows a schematic view of a lower printing plate exchange device as shown in FIG. 1.
Figure 8:
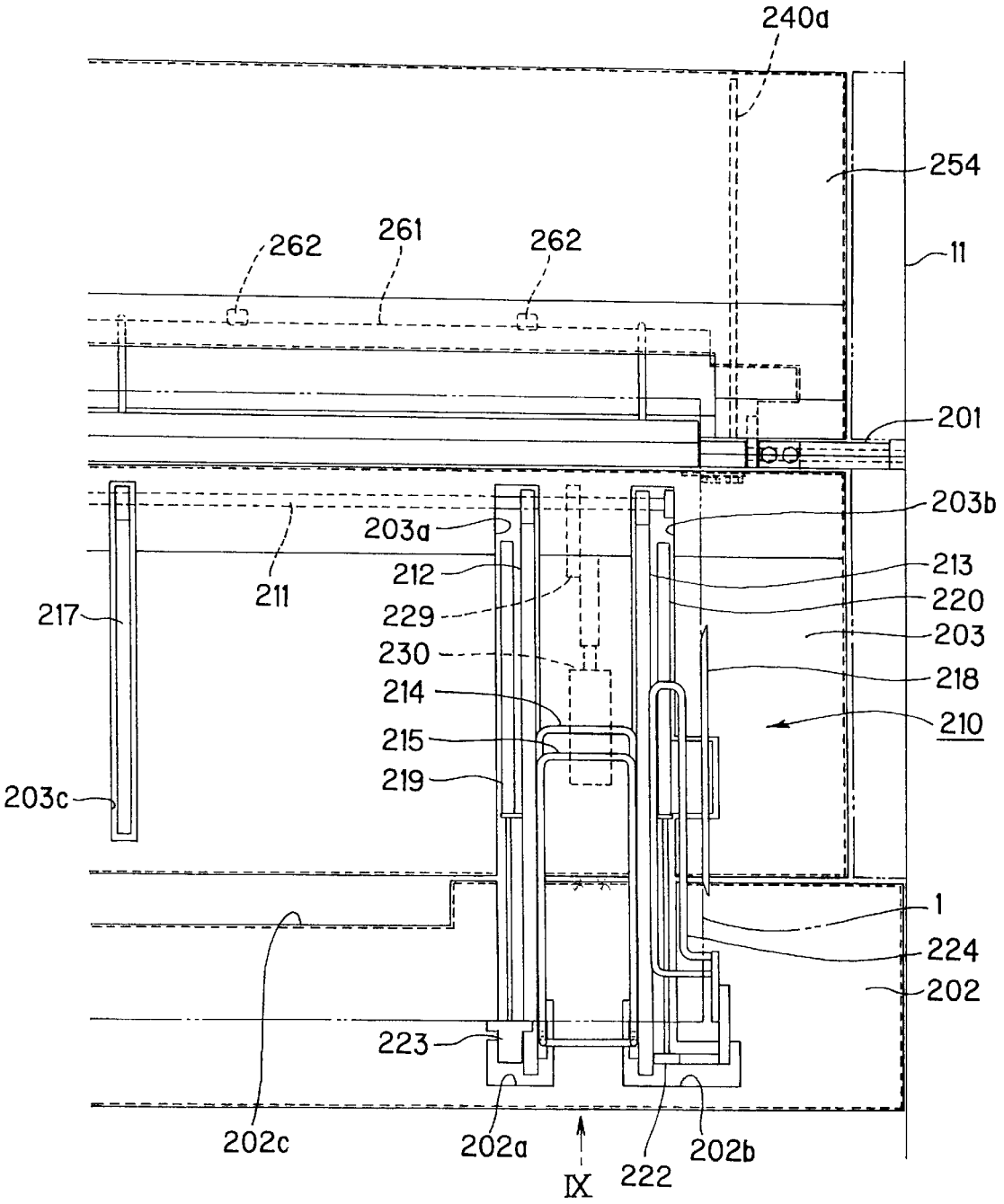
FIG. 8 shows a partially enlarged view of the device taken along a line VIII—VIII in FIG. 7.
Figure 9:
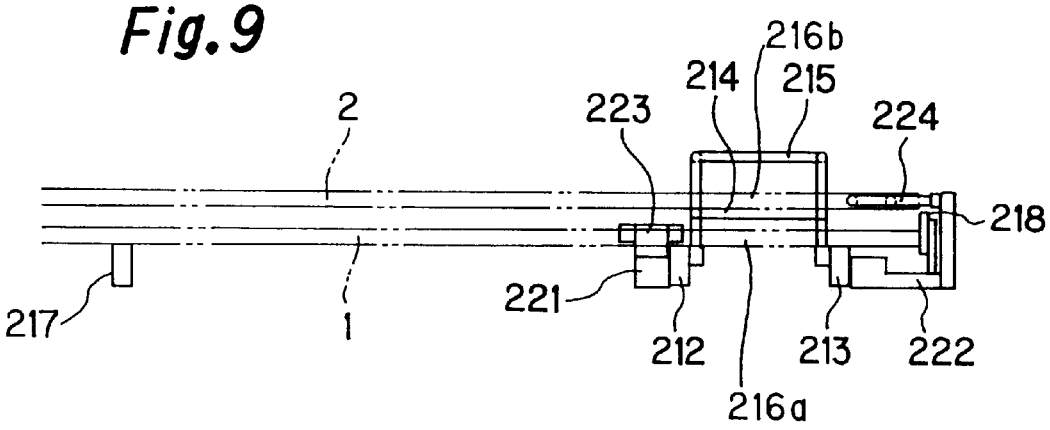
FIG. 9 shows a partially enlarged view of the device taken along a line IX—IX in FIG. 8.
Figure 10:
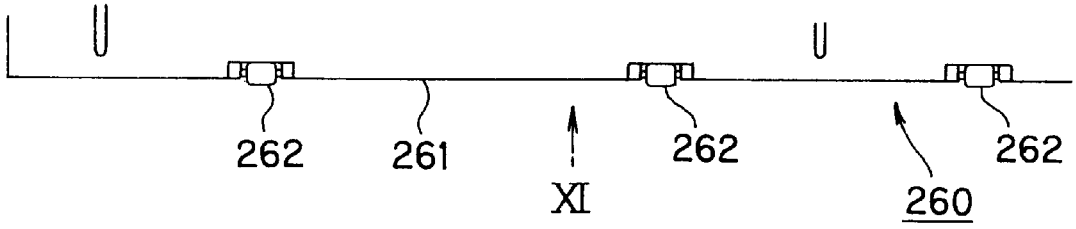
FIG. 10 shows a partially enlarged view of the device taken along a line X—X in FIG. 7.
Figure 11:
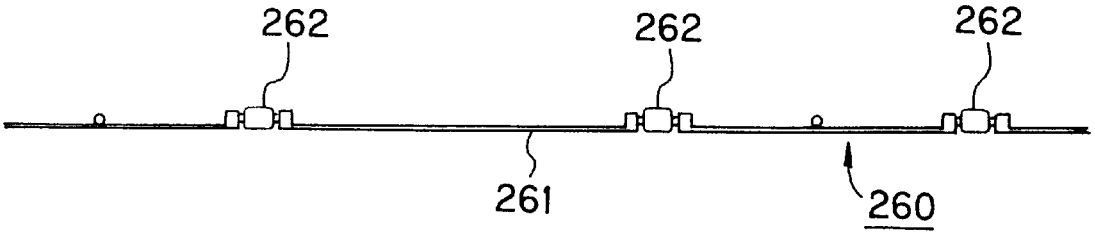
FIG. 11 shows a device taken along a line XI—XI in FIG. 10.

An embodiment of a printing press according to the present invention is described with reference to FIG. 1 to FIG. 11. FIG. 1 is a schematic view of a device for feeding a printing plate to a plate cylinder of a printing press, particularly to an offset sheet printing press. FIG. 2 shows an upper portion of the device as shown in FIG. 1. FIG. 3 shows a partial enlarged view of the device taken along a line III—III in FIG. 2. FIG. 4 shows a partial enlarged view of the device taken along a line IV—IV in FIG. 3. FIG. 5 shows a partial enlarged view of the device taken along a line V—V in FIG. 2. FIG. 6 shows a partial enlarged view of the device taken along a line VI—VI in FIG. 5. FIG. 7 shows a lower portion of the device as shown in FIG. 1. FIG. 8 shows a partial enlarged view taken along a line VIII—VIII as shown in FIG. 7. FIG. 9 shows a partial enlarged view taken along a line IX—IX as shown in FIG. 8. FIG. 10 shows a partial enlarged view taken along a line X—X as shown in FIG. 9. FIG. 11 is a drawing taken along a line XI—XI as shown in FIG. 10.

As shown in FIG. 1, an upper plate cylinder 12 is provided at a location between a pair of upper right- and upper left-portions of the frames 11 of a printing unit. The upper cylinder 12 confronts with an upper rubber cylinder 14. On the other hand, a lower plate cylinder 13 is provided at a location between a pair of lower right- and lower left-frames 11. The lower plate cylinder 12 confronts with a lower rubber cylinder 15. The upper rubber cylinder 14 and the lower rubber cylinder 15 confront each other and a printed medium such as a web member is passed through the pair of the rubber cylinders 14 and 15.

When ink and dampening water is supplied from an ink supply device and a water supply device (not shown) to the plate cylinders 12, 13, respectively, ink corresponding to a picture pattern on plates of the plate cylinders 12 and 13 is transferred to the rubber cylinders 14 and 15, respectively, so that double sides of a printed medium are printed by passing between the rubber cylinders 14 and 15.

In the present embodiment, an upper printing portion comprises the upper plate cylinder 12, the upper rubber cylinder 14, the ink supply device and the water supply device and a lower printing portion comprises the lower plate cylinder 13, the lower rubber cylinder 15, the ink supply device and the water supply device.

Upper Plate Exchange Device

As shown in FIG. 1, an upper plate exchange device 100 is provided near the upper plate cylinder 12. The upper plate exchange device 100 comprises the following components.

At each upper end of the right- and left-frames 11, one end of a L-shaped support arm 101 is supported so as to rotate along the same rotational direction of the upper plate cylinder 12. As shown in FIG. 2 and FIG. 3, the opposite end of the support arm 101 is supported so as to rotate along the same rotational direction of the upper plate cylinder 12.

Upper Plate Holding Device

An upper plate holding device 110 is means for holding a printing plate of a printing press according to the present invention and supported between the support frames 102 so as to rotate along the same rotational direction of the upper plate cylinder 12. The upper plate holding device 110 comprises the following components.

As shown in FIG. 2 and FIG. 3, a supporting axis 111 is connected and supported at a location between the support frames 102 so as to rotate along the same rotational direction of the upper plate cylinder. Each end portion of a pair of plate-shaped guide frames 112, 113 arranged along an axial direction is connected and supported to a respective end of the supporting axis.

As shown in FIG. 2 to FIG. 4, each opposite end of the guide frames 112 (113) is connected and fixed at a base end portion 114*a* (115*b*) of the first- (second-) guide portion 114 (115) extending toward one end of the guide frame 112 (113) substantially parallel to the longitudinal direction of the guide frame 112 (113).

A space is provided between the guide frames 112, 113 and the first guide member 114 so as to form a stored portion 116*a* for storing a discharged printing plate 2. When the upper holding device 110 is positioned as shown in FIG. 2, one end of the discharged plate 2 stands on the base end portion 114*a* of the first guide member 114 and a surface of the discharged printing plate 2 is supported by the guide frames 112 and 113 and the opposite surface of the discharged plate 2 is supported by the first guide member 114.

A space is provided between the first and second guide members 114 and 115 so as to form a stored portion 116*b* for storing a new printing plate 1. When the upper plate holding device 110 is positioned as shown in FIG. 2, a new printing plate 1 stands on the base end portion 115*b* of the second guide portion 115, one surface of the new printing plate 1 is supported by the first guide member 114 and the opposite surface of the new printing plate 1 is supported by the second guide member 115.

In the above embodiment, means for storing a discharged printing plate is constituted by the guide frames 112 and 113, the first guide member 114 and so on and means for storing a new printing plate is constituted by the first and second guide members 114 and 115.

One end of a link plate 129 is connected and fixed at the supporting axis 111. At the opposite end of the link plate 129, a front end of an actuator 130 is pivotally connected. A base end of the actuator 130 is pivotally supported by the support frame 102.

Figure 12:
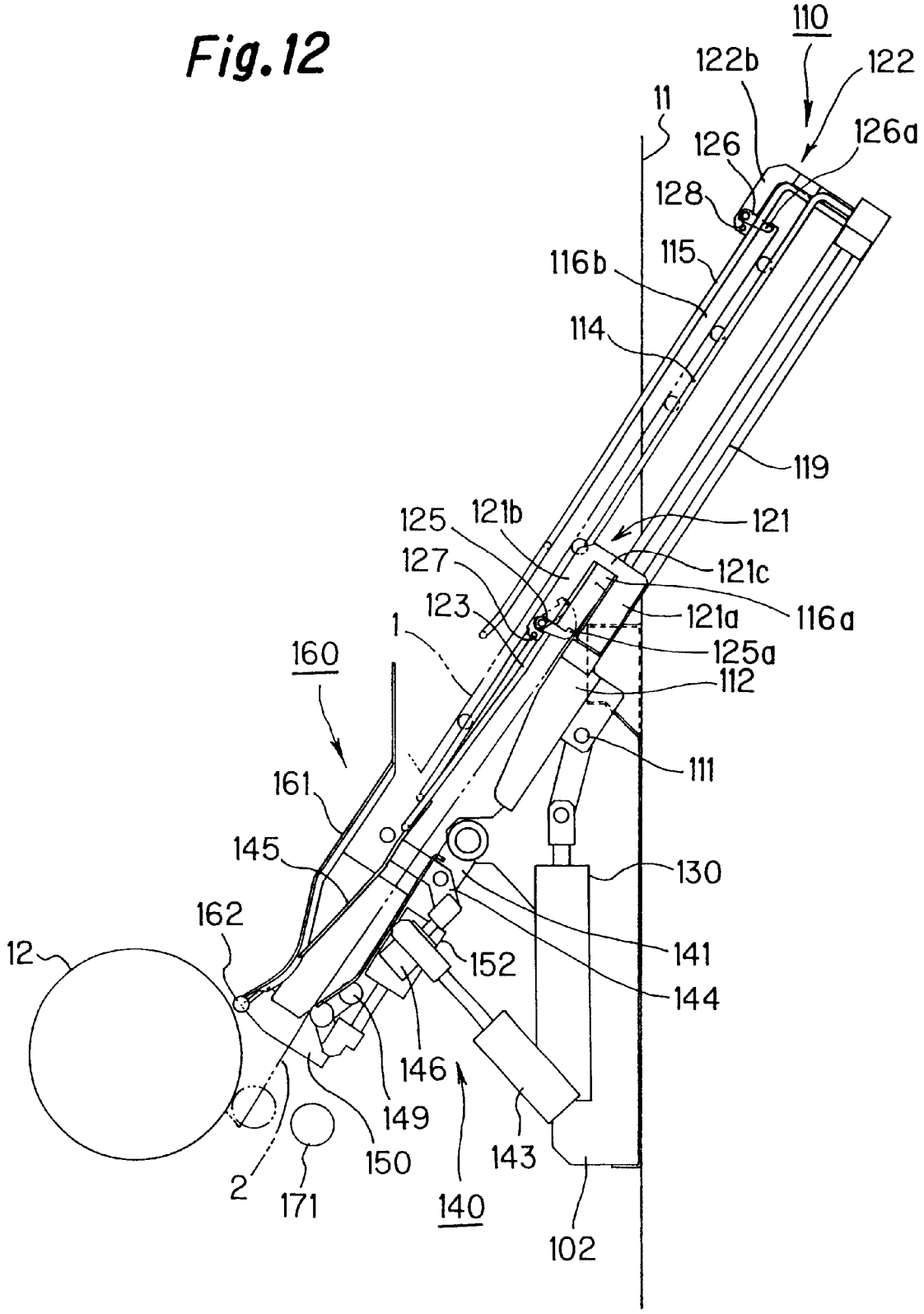
FIG. 12 shows a step for exchanging a printing plate in the upper printing plate exchange device.

That is, in the case that the actuator 130 is extended, the supporting axis 111 is rotated though the link plate 129 so as to switch the upper printing plate holding device 110 including the guide frames 112 and 113 between a released position (as shown in FIG. 2) and an operation position (as shown in FIG. 12) as described below. In the embodiment, moving means comprises the link plate 129 and the actuator 130.

At a front end of the second guide portion 115, a hooking member 115*a* is affected as a release member and outwardly protruded from the guide frame 113. At the guide member 114 between the guide frames 112 and 113, a plurality of guide rollers 117 for rotating along the same rotational direction of the upper printing plate cylinder 12 are provided along the longitudinal direction of the guide frames 112 and 113 separated with a predetermined interval. At the guide frame 13, a contacting plate 118 for restricting the new printing plate 1 sliding along a width direction is attached through a bracket (not shown).

Figure 13:
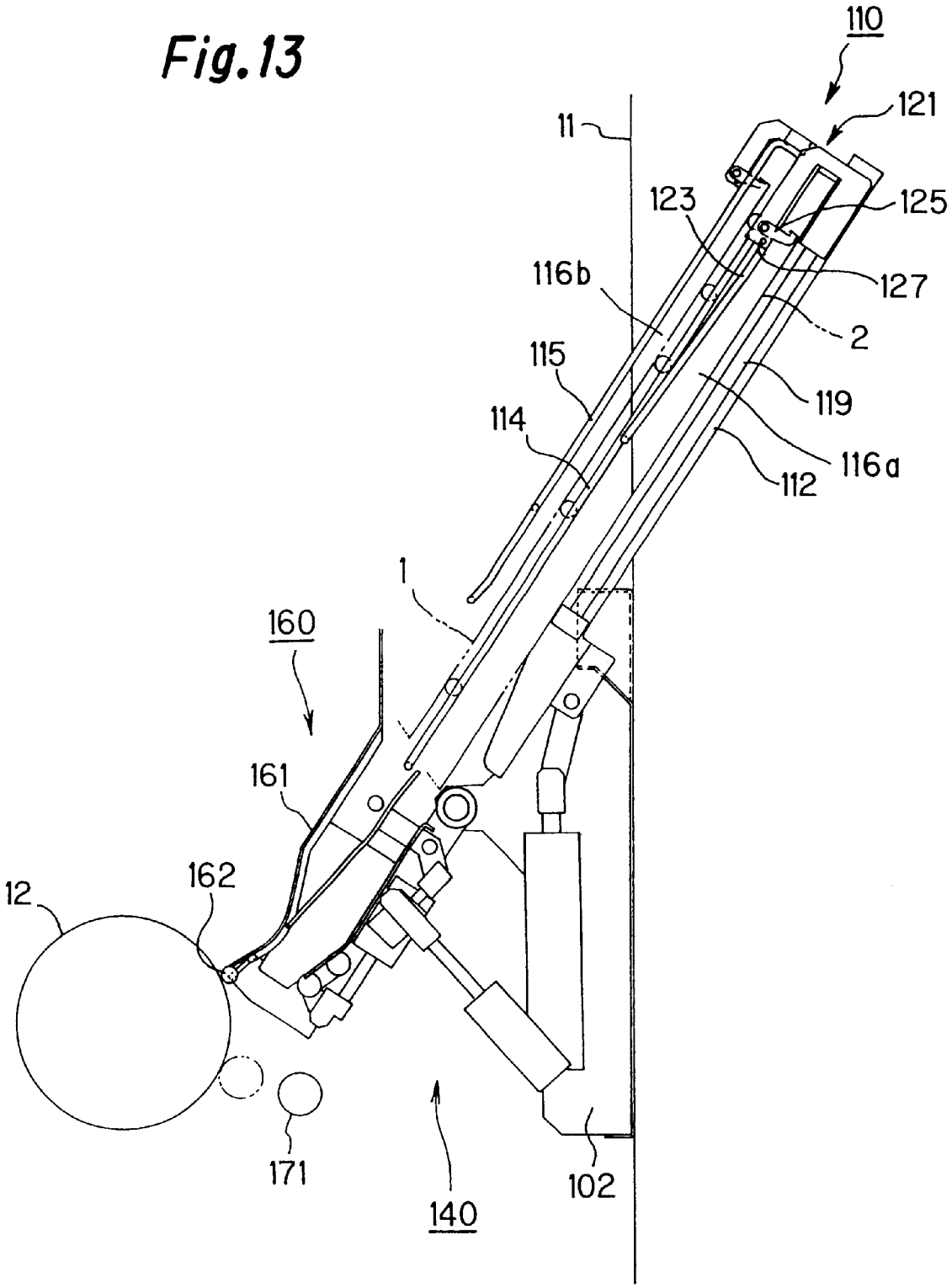
FIG. 13 shows a step following the step as shown in FIG. 12.

At each outside surface of the confronting guide frames 112 (113), a rodless cylinder 119 (120) is attached as moving means wherein an axial direction of the cylinder 119 (120) is arranged along the longitudinal direction of the guide frame 112 (113). A base end portion 121*a* of a U-shaped supporting member 121 of which an opening end is confronting to a front edge of the guide frame 112 is attached to the rodless cylinder 119. The supporting member 121 can be slid along the longitudinal direction of the guide frame 112 between a position as shown in FIG. 12 described below in detail and a stored position as shown in FIG. 13 by the rodless cylinder 119. A length of a connecting portion 121*c* is designed so as to position a height of a front end 121*b* of the supporting member 121 at the same level of an extending portion of the guide member 114.

At the front end 121*b* of the supporting member 121, a base end of the guide member 123 is connected and fixed, wherein a longitudinal direction is arranged along a longitudinal direction of the guide frame 112. At the front end 121*b* of the supporting member 121, a base end of the hook 125 with a claw portion 125*a* provided at a tip portion is affected as the discharged printing plate holding member and supported so as to rotate along the same rotational direction of the supporting axis 111. When the longitudinal direction of the front end portion 121*b* of the supporting member 121 is arranged toward a direction as shown in FIG. 13 as described below, the hook 125 is moved by the dead weight itself so as to position the claw portion 125*a* at the base end portion 121*a* so that the claw portion 125*a* is advanced into the stored portion 116*a*. When the longitudinal direction of the front end portion 121*b* of the supporting member 121 is arranged toward a straight direction as shown in FIG. 2, the hook 125 is moved by the dead weight itself so as to overlap the claw portion 125*a* on the front end portion 121*b* so that the claw proton 125*a* is going out from the stored portion 116*a*.

Thus, the hook 125 is located nearer than the connecting portion 121*c* of the supporting member 121 with respect to a front end of the guide frame 112. In other words, when the hook 125 is located in the stored position, the hook 125 is positioned at an upper stream side with respect to the base end 114*a* located at a down stream end of the stored portion 116*a* in the discharged printing plate storing direction. A length between a pivotal point of the hook 125 and the base end portion 114*a* is longer than a length between the pivot point of the hook 125 and the claw portion 125*a*. In other words, a length between the above pivot point of the hook 125 in the stored position and an end portion of the storing portion 116*a* at a down stream side in the discharged printing plates storing direction is longer than a distance between the pivot point and the front end portion of the hook 125.

A stopper pin 127 is protruded and mounted as a pivot restricting member at the front end portion 121*b* of the support member 121 near the base end of the hook 125. The stopper pin 127 avoids for the claw portion 125*a* of the hook 125 advanced to the stored portion 116*a* toward the front end side of the guide member 123.

Figure 14:
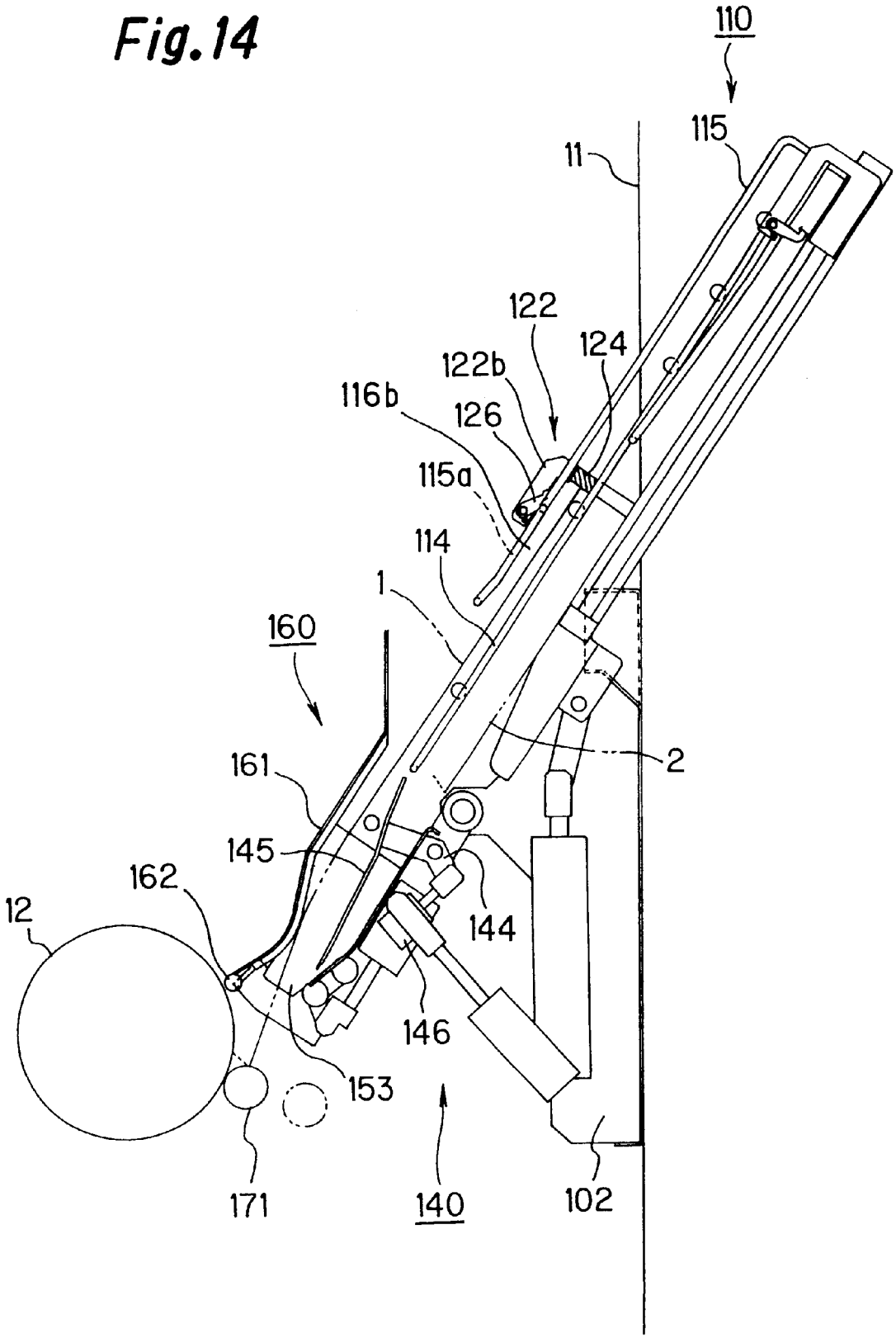
FIG. 14 shows a step following the step as shown in FIG. 13.

On the other hand, the base end side 122*a* of the U-shaped support member 122 of which an opening portion confronts toward the front end side of the guide frame 113 is provided at the rodless cylinder 120. The support member 122 can be slid between a stored position as shown in FIG. 13 and a position as shown in FIG. 14 by the rodless cylinder 120. A length of the connecting portion 122*c* is designed so as to locate the front end portion 122*b* of the supporting member 122 slightly higher than the extending portion of the guide portion 115.

The hook 126 having a claw portion 126*a* at the front end is affected as means for holding a new printing plate and pivotally supported by the front end 122*b* of the support member 122 so as to rotate along the same rotational direction of the support axis 111. When the longitudinal direction of the front end portion 122*b* of the supporting member 122 is arranged toward a direction as shown in FIG. 13, the claw portion 126*a* of the hook 126 is moved to the base end 122*a* by the dead weight so as to advance the claw portion 126*a* into the stored portion 116*b*. When the longitudinal direction of the front end portion 122*b* of the support member 122 is arranged toward a straight direction as shown in FIG. 2, the claw portion 126*a* is moved by the dead weight so as to overlap on the front end portion 122*b* so that the claw portion 126 can go out from the stored portion 116*b*.

Thus, the hook 126 is located nearer than the connecting portion 122*c* of the supporting member 122 with respect to the front end of the guide frame 113. In other words, when the hook 126 is in the stored position, the hook 126 is positioned at the down stream with respect to the base end 115*b* which is positioned at an upper stream with respect to the stored portion 116*b* in a new printing plate supply direction. A length between a pivot point of the hook 126 and the base end portion 115*b* is longer than a length between a pivot point and the claw portion 126*a* of the hook 126. In other words, a length between the pivot point of the hook 126 in the stored position and an upper stream end of the stored portion 116*b* in the new printing plate supply direction is longer than a length of the pivot point and the front end of the hook 126.

A stopper pin 128 is protruded and mounted as a pivot restricting member at the front end portion 122*b* of the support member 122 near the base end of the hook 126. The stopper pin 128 avoids for the claw portion 126*a* of the hook 126 advanced to the stored portion 116*b* toward the front end side of the guide member 115. A press plate 124 is affected as a contacting member and protruded at a portion between the guide portions 114 and 115 of the connecting portion 122*c* of the supporting member 122.

Upper First Plate Guiding Device

As shown in FIG. 2, each base end of a pair of pivot frames 141 of an upper first plate guide device 140 is pivotally connected and supported at a respective side of the upper plate cylinder 12 with respect to the supporting axis 111 of the support frame 102 so as to rotate the frame 141 along the same direction of the supporting axis 111. The upper first plate guiding device 140 comprises the following components.

At the pivotal frame 141, a fixed guide plate 142 for guiding a movement of a discharged printing plate 2 is attached. A front end of an actuator 143 is pivotally connected to the pivotal frame 141. The support frame 102 is pivotally supported at a base end of the actuator 143. That is, the pivotal frame 141 can be rotated by extending/contracting the actuator 143 so that the pivotal frame 141 can be rotated between a guide position for guiding a new printing plate 1 and a discharged printing plate 2 adjacent the upper plate cylinder 12 (as shown in FIG. 12) and a shelter position (see FIG. 2) released from the upper plate cylinder 12.

A middle portion of a link plate 144 is pivotally connected to the pivotal frame 141. A guide plate 145 is attached at a front end of the link plate 144 and affected as a straddle guide. A front end of the actuator 146 is connected to a base end of the link plate 144. A base end of the actuator 146 is pivotally supported by the pivotal frame 141. That is, the guide plate 145 can be moved between a discharged printing plate guiding position (see FIG. 12) and a new printing plate guiding position (as shown in FIG. 14) by extending/contracting the actuator 146 though the link plate 144 (described in detail herein below).

At a front end of the pivot frame 141, a rotational axis 147 is pivotally supported so as to rotate along the same rotational direction of the upper plate cylinder 12. A base end of a support plate 148 is connected and fixed at the rotational axis 147. Guide rollers 149 are rotatably provided at a front end of the support plate 148. A U-shaped turning plate of which a longitudinal direction is arranged along the axial direction of the upper plate cylinder 12 is connected to the rotational axis 147. One end of a connecting plate 151 is connected and fixed at the rotational axis 147. A front end of an actuator 152 is pivotally connected to the opposite end of the connecting plate 151. A base end of the actuator 152 is pivotally supported by the turning frame 141. The rotational axis is rotated through the connecting plate 151 by extending/contracting the actuator 152 so that the guide rollers 149 and the turning plate 150 can be moved.

A positioning plate 153 for adjusting a position of a printing plate along a width direction is attached to the pair of turning frames 141.

Upper Second Printing Plate Guide Device

As shown in FIGS. 2, 5 and 6, an upper second printing plate guide device is provided near the upper plate cylinder 12. The upper second printing plate guide plate 160 comprises a guide plate 161 as a guiding member and a plurality of guiding rollers 162 pivotally provided at an end confronting with the upper plate cylinder 12 of the guide plate 161.

Upper Press Roller

As shown in FIG. 2, an upper press roller 171 is provided near the upper plate cylinder 12 in order to approach to and released from the upper plate cylinder 12.

Safety Cover

As shown in FIGS. 2 and 3, a safety cover 103 for covering the printing press according to the present invention is provided for dividing at least one portion in a space between an internal portion and an external portion of the upper printing portion. In a shelter position of the upper printing plate holding device 110 as shown in FIG. 2, the stored portions 116*a* and 116*b* of the upper printing plate holding device 110 are located at an exterior side with respect to the safety cover 103 and the guide frames 112 and 113, the rodless cylinders 119 and 120, base end portions 121*a* and 122*a* of the support members 121 and 122 and the upper first printing plate guide device 140 positioned at a left side with respect to the stored portion 116*a* of the upper printing plate holding device 110 as shown in FIG. 2 at an interior side with respect to the safety cover 103. Therefore, the safety covers 103 provides a plurality of spaces 103*a* so as to provide spaces 103*a* corresponding to the guide frames 112 and 113 of the upper printing plate holding device 110, the rodless cylinders 119 and 120 and base end portions 121*a* and 122*a* of the supporting members 121 and 122.

Thus, the safety cover 103 is pivotally supported by the frame 11 through support members such as the support arm 101, the support frame 102 and so on so that at least one space formed between the pair of frames 11 can be shifted from/to a closed position for closing the space to/from a released position for releasing the space. The upper printing plate holding device 110 is supported by the safety cover 103 through the support frame 102 in order to rotate the upper printing plate holding device 110 to the operation position (as shown in FIG. 12) relatively to the safety cover 103.

A safety cover 103 formed between the left side guide frame 112 and the right side guide frame 113 of the upper printing plate holding device 110 is shorter than a longitudinal length between the guide frames 112 and 113 of the upper printing plate holding device 110 so that the safety cover 103 can be turned with the maximum rotational radius smaller than the maximum rotational radius of the upper printing plate holding device 110.

Lower Printing Plate Exchange Device

As shown in FIG. 1, a lower printing plate exchange device 200 is provided near the lower plate cylinder 13. The lower printing plate exchange device 200 comprises the following components.

As shown in FIGS. 7 and 8, a supporting axis 201 is supported at the left- and right-frames 11, wherein an axial direction of the supporting axis 201 is arranged toward the axial direction of the lower plate cylinder 13.

Safety Cover

At the support axis 201, a safety cover 203 for covering the printing press according to the present invention is pivotally connected and supported, wherein the safety cover 203 comprises opening portions 203*a* and 203*b* and a slit 203*c*. The safety cover 203 is pivotally supported by the frames 11 through the support axis 201 so that at least one space formed between the pair of the frames 11 can shift between a close position for closing the space and a release position for releasing the space. The longitudinal distance of the safety cover 203 is shorter than that of the guide frames 212 and 213 of the lower printing plate holding device 210 as described below so that the maximum turning radius of the safety cover 203 can be shorter than the maximum turning radius of the lower printing plate holding device 210. As shown in FIGS. 7 and 8, a safety cover 202 with opening portions 202*a*~202*c* is fixed at lower portions of the left side and right side of the frames 11.

Lower Printing Plate Holding Device

At a side of the lower plate cylinder 13 of the safety cover 203, a rotational axis 211 of the lower printing plate holding device 210 is affected as means for holding a printing plate in the printing press according to the present invention and pivotally connected and supported so as to rotate along the same rotational direction of the lower plate cylinder. The lower printing plate holding device 210 comprises the following components.

As shown in FIGS. 7 to 9, each end of a pair of a plate-shaped guide frames 212 and 213 is arranged along the axial direction of the lower plate cylinder 113 and connected and fixed at the opening portions 203*a* and 203*b* of the safety cover 203 of the rotational axis 211, respectively. In each slit 203*c* of the safety cover 203 of the rotational axis 211, one end of a plate-shaped support frame 217 is connected and fixed.

At the opposite end of the guide frame 212 (213), a base end of the guide member 214 (215) arranged in parallel with the longitudinal direction of the guide frame 212 (213) and extending toward one end of the guide frame 212 (213) is connected and fixed. The guide members 214 and 215 are outwardly protruded from the opening portions 203*a* and 203*b* of the cover 203 so as to locate the lower printing plate holding device 210 at an exterior side with respect to the safety cover 203 as shown in FIG. 7 and form a space therebetween in order to provide a stored portion 216*b* for storing the discharged printing plate 2. A space is provided between the guide frames 212 and 213 and the guide member 214 so as to provide a stored portion 216*a* for storing the new printing plate 1.

In the embodiment, means for storing a new printing plate comprises the above described guide frames 212 and 213 and the guide member 214 and means for storing a discharged printing plate comprises the guide members 214 and 215.

One end of the link plate 229 is connected and fixed to the rotational axis 211. The opposite end of the link plate 229 is pivotally connected to the front end of the actuator 230. A base end of the actuator 230 is pivotally supported by the safety cover 203.

Figure 16:
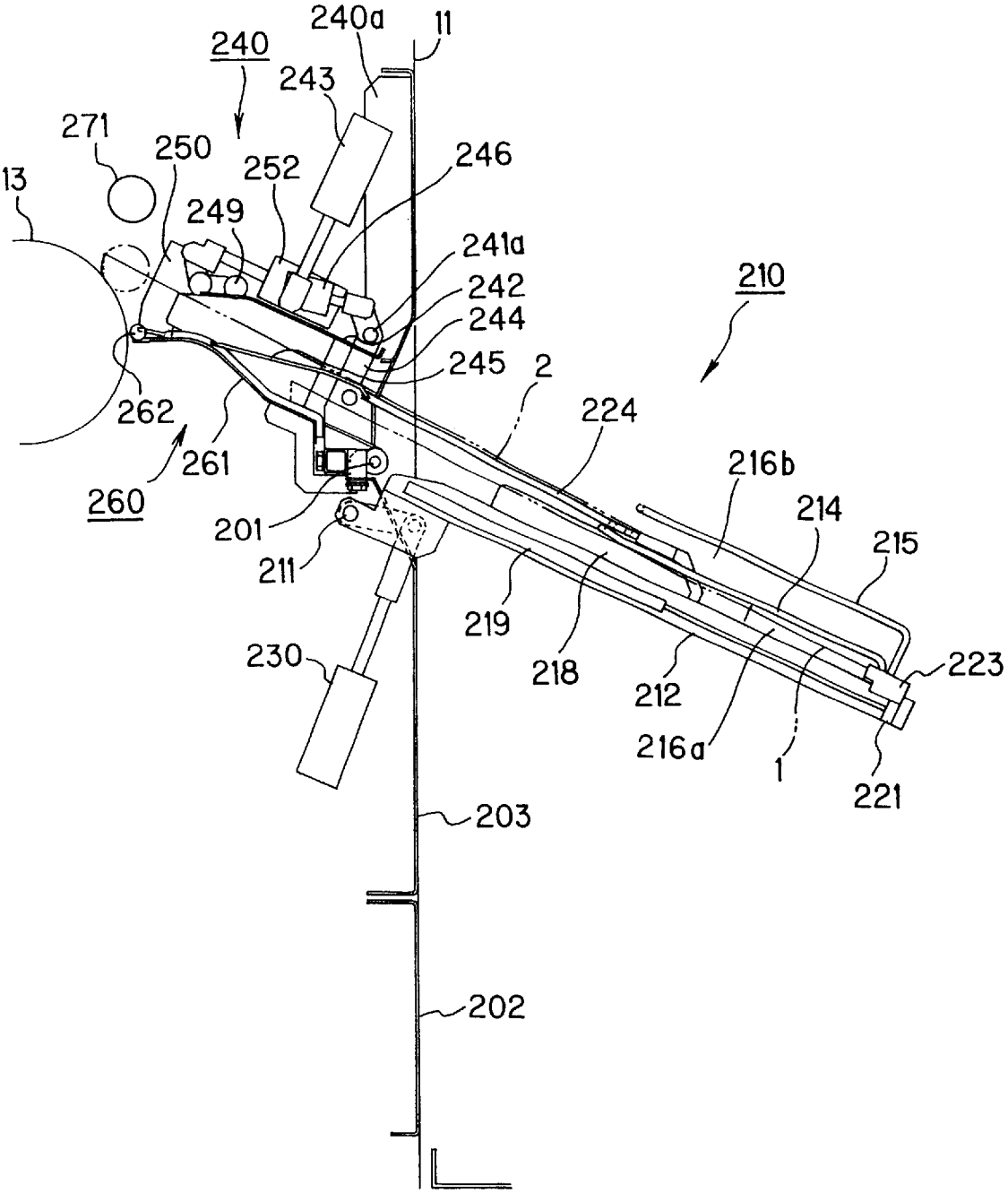
FIG. 16 shows a step for exchanging a printing plate in the lower printing plate exchange device.

The rotational axis 211 is rotated by extending and contracting the actuator 230 through the link plate 229 so that the lower printing plate holding device 210 comprising the guide frames 212 and 213 and the support 217 can move between a shelter position (as shown in FIG. 7) and an operation position (as shown in FIG. 16) described in detail hereinafter. The link plate 229, the actuator 230 and so on constitute moving means in the present embodiment.

Figure 17:
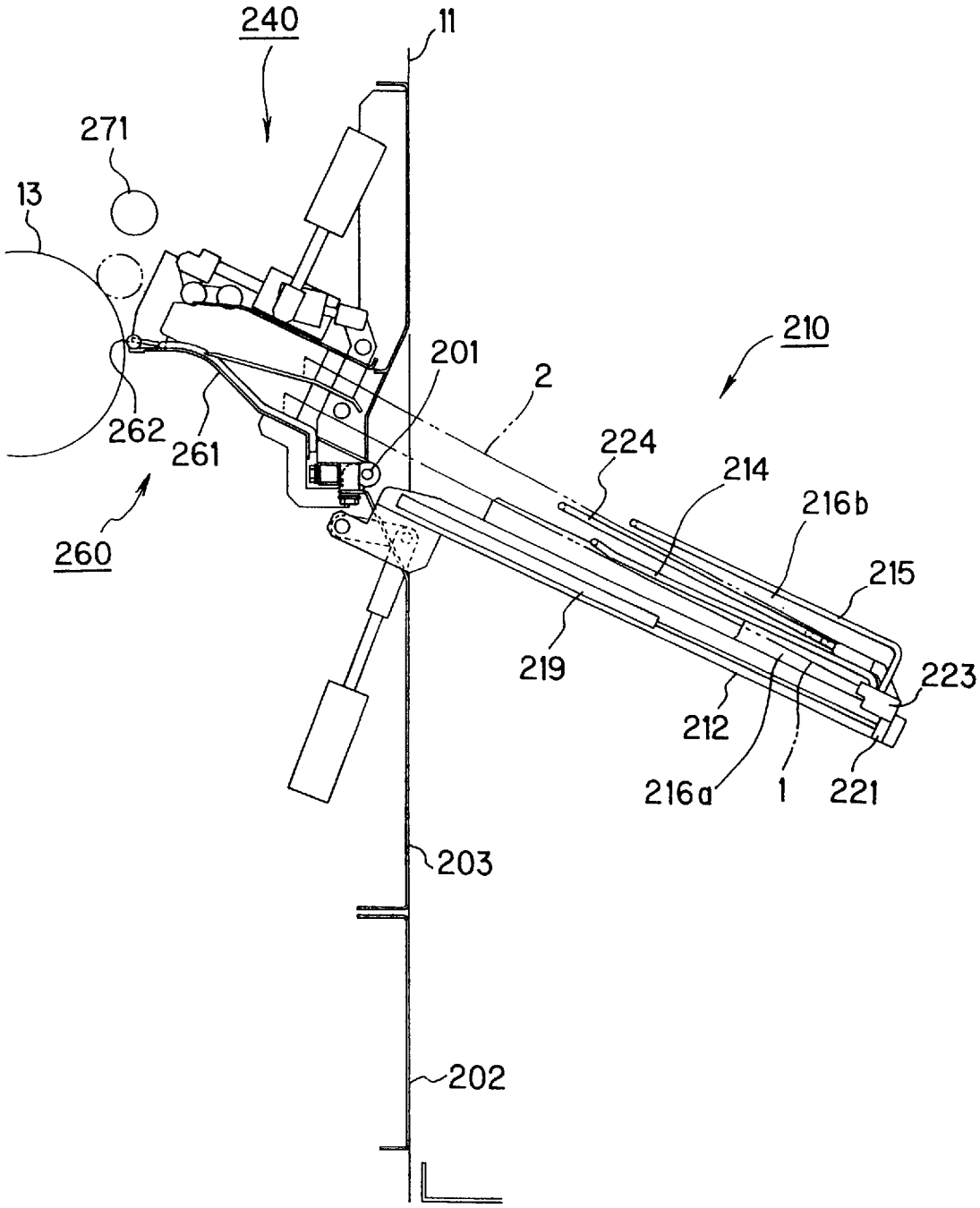
FIG. 17 shows a step following the step as shown in FIG. 16.
Figure 18:
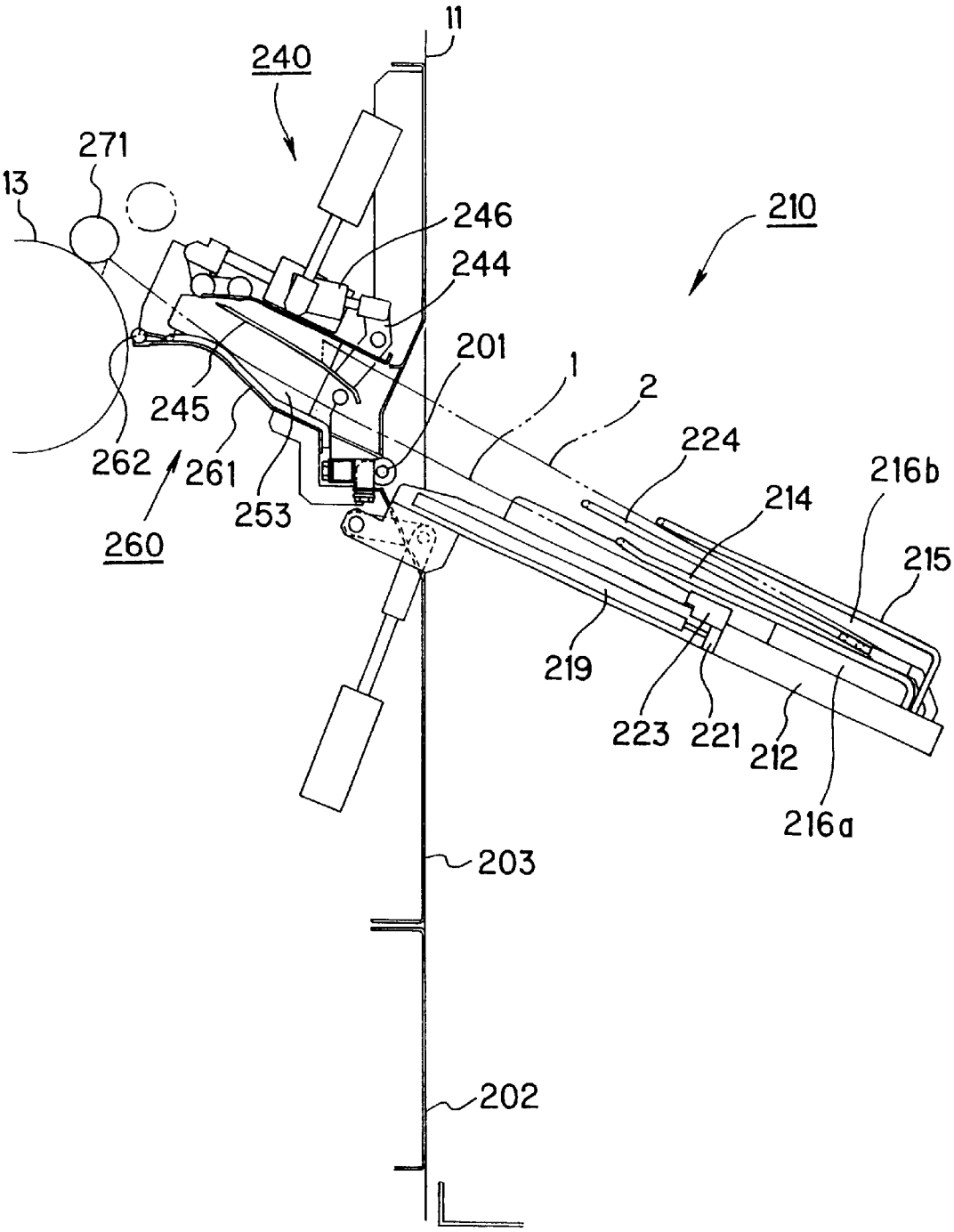
FIG. 18 shows a step following the step as shown in FIG. 17.

A contacting plate 218 for restricting the new printing plate sliding in the width direction is attached to the guide frame 213 through a bracket. The actuators 219 and 220 is attached at an exterior side of the guide frames 212 and 213 with respect to a confronting surface of the guide frames 212 and 213, respectively, wherein the axial direction of the actuators 219 and 220 is arranged along the longitudinal direction of the guide frames 212 and 213, respectively. A support device 221 is pivotally attached at a front end of a rod of the actuator 219 by extending and contracting the rod of the actuator 219 between the positions as shown in FIGS. 17 and 18. An extrusion member for extruding a new printing plate is attached to the supporting member 221. The extrusion member 223 is outwardly protruded from the opening portions 202*a* and 203*a* of the safety cover 202 and 203 so as to position between the safety covers 202 and 203 and the guide member 214 when the lower printing plate holding device 210 is positioned as shown in FIG. 7.

A support member 222 is attached at a front end of a rod of an actuator 220 so as to move between positions as shown in FIGS. 16 and 17 described below by extending and contracting the rod of the actuator 220. A receiving member 224 for receiving a discharged printing plate 2 is provided at the support member 222. The receiving member 224 is outwardly protruded from the opening portions 202*b* and 203*b* of the safety covers 202 and 203 so as to position between the guide members 214 and 215 when the lower printing plate holding device 210 is positioned as shown in FIG. 7.

Lower First Printing Plate Guide Device

As shown in FIGS. 7 and 8, base ends of a pair of frames 240*a* of the lower first printing plate guiding device 240 are pivotally connected and supported at an upper side of the support axis 201 so as to rotate along the same direction of the upper plate cylinder 13. The upper first printing plate guide device 240 comprises the following components.

A rotational axis 241*a* of which the axial direction is arranged along the axial direction of the support axis 201 is attached to the frame 240*a*. At the rotational axis 241*a*, the base end of the rotational frame (not shown) and a middle portion of a link plate 244 as a straddle guide are pivotally provided. A fixed guide plate 242 for feeding the discharged printing plate 2 is provided at the pivotal frame. A front end of the actuator 243 is pivotally connected to the pivot frame. A base end of the actuator 243 is pivotally supported by the body frame 240*a*. The pivot frame is rotated by extending and contracting the actuator so that the guide plate 242 can be moved between a guide position near the lower plate cylinder and guiding the new printing plate 1 and the discharged printing plate 2 (see FIG. 16) and a shelter position released from the lower plate cylinder 13 (see FIG. 7).

A guide plate 245 is affected as a straddle guide and provided at a front end of the link plate 244. A front end of the actuator 246 is connected at a base end of the link plate 244. The base end of the actuator 246 is pivotally supported by the pivot frame. The guide plate 245 can be moved between a position for guiding a discharged printing plate (see FIG. 16) and a position for guiding a new printing plate (see FIG. 18) by extending and contracting the actuator 246 through the link plate 244 (described in detail hereinafter).

At the front end of the pivot frame, a rotational axis 247 for rotating along the same direction of the lower plate cylinder 13 is rotatably supported. A base end of the support plate 248 is connected and fixed at the rotational axis 247. A guide roller 249 is rotatably provided at a front end of the support plate 248. A substantially U-shaped turning plate 250 of which a longitudinal direction is arranged along an axial direction of the lower plate cylinder 13 is connected and supported by the rotational axis 247. One end of a connecting plate 251 is connected and fixed at the rotational axis 247. A front end of an actuator 252 is pivotally connected to the opposite end of the connecting plate 251. The base end of the actuator 252 is pivotally connected to the pivot frame. Thus, the rotational axis 247 is rotated by extending and contracting the actuator 252 through the connecting plate 251 so that the guide roller 249 and the turning plate 250 can be moved.

Positioning plates 253 for positioning a plate along the width direction is provided at a pair of the pivot frames, respectively. A cover 254 is provided at the pivot frame.

Lower Second Printing Plate Guide Device

As shown in FIGS. 7, 10 and 11, a lower second printing plate guide device 260 is provided near the lower plate cylinder 13. The lower second printing plate guiding device 260 comprises a guide plate 261 as a guiding member of which a base end is pivotally connected and supported by the support axis 201 and a plurality of guiding rollers 262 at the end of the lower plate cylinder side (front end) of the guide plate 261. The lower second printing plate guiding device 260 can be moved between a guiding position for guiding a new printing plate 1 supplied to the lower plate cylinder 13 and a discharged printing plate discharged from the plate cylinder 13 and a shelter position located far from the lower plate cylinder 13.

Lower Press Roller

As shown in FIG. 7, a lower press roller 271 is provided near the lower plate cylinder 13 so as to approach to and be released from the lower plate cylinder 13.

In a shelter position of the lower printing plate holding device 210 as shown in FIG. 7, the safety covers 202 and 203 locate the stored portions 216*a* and 216*b* of the lower printing plate holding device 210 at an exterior side with respect to the safety covers 202 and 203 and the guide frames 212 and 213, the support frame 217, the actuators 219 and 220, base end of support members 221 and 222 located at a left side with respect to the stored portion 216*a* of the lower printing plate holding device 210 as shown in FIG. 7 at an interior side with respect to the safety covers 202 and 203. Therefore, the opening portions 202*a*, 202*b*, 203*a* and 203*b* and the slit 203*c* are formed at positions corresponding to the guide frames 212 and 213, the support frame 217, the actuators 219 and 220, the base ends of the support members 221 and 222 of the lower printing plate holding device 210, respectively.

Figure 15:
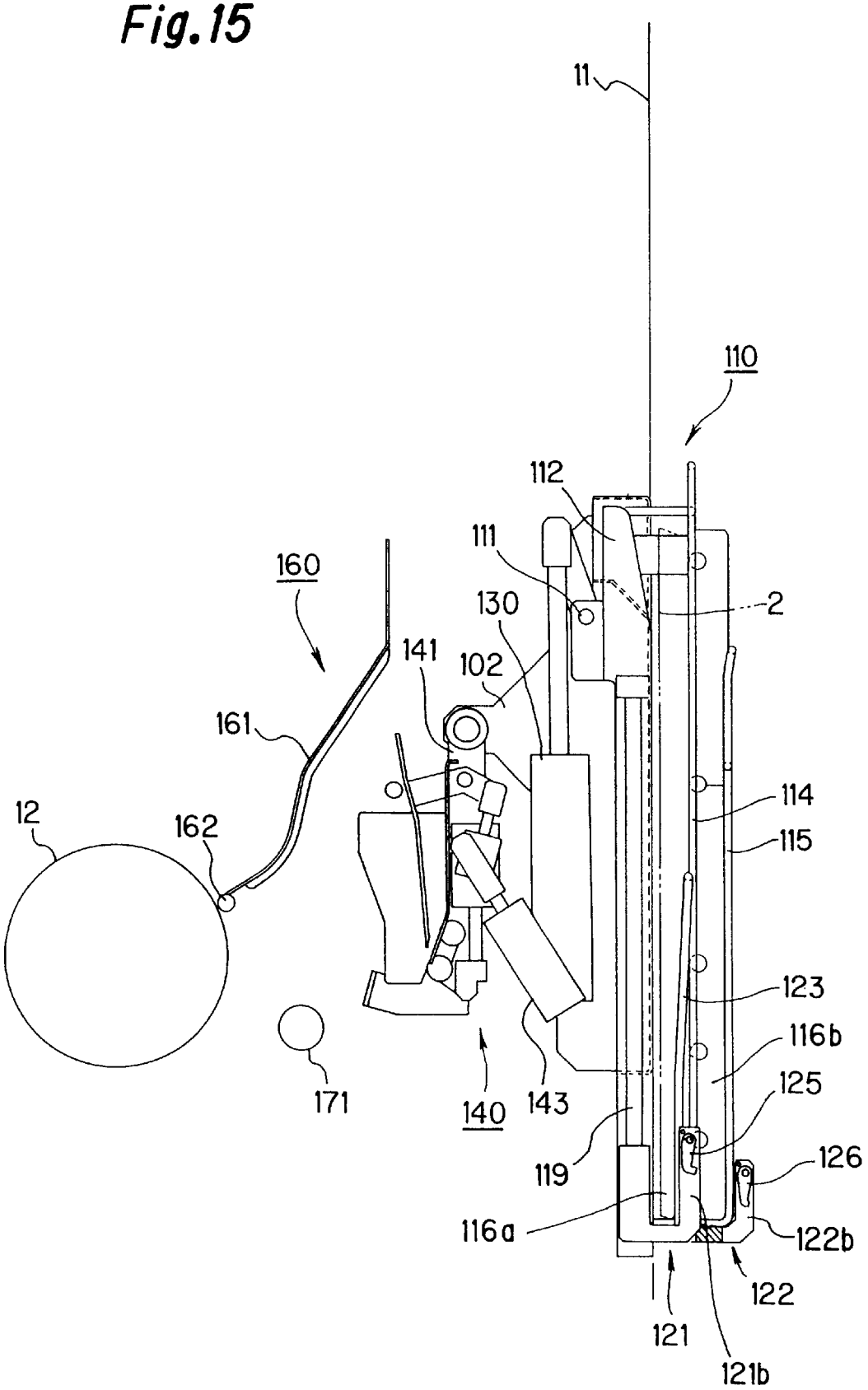
FIG. 15 shows a step following the step as shown in FIG. 14.
Figure 19:
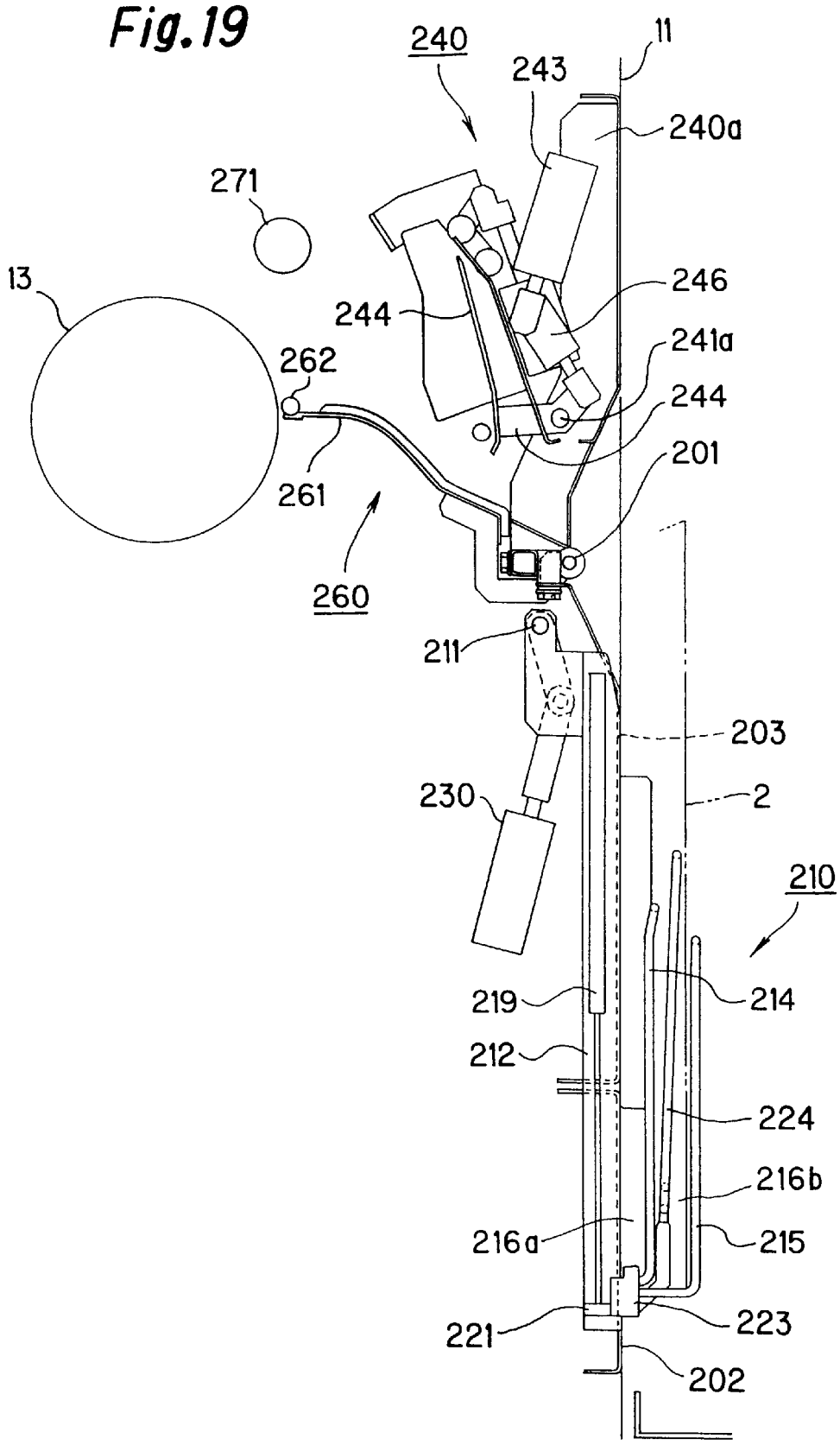
FIG. 19 shows a step following the step as shown in FIG. 18.

An operation for exchanging printing plates in the upper printing plate exchange device 100 and the lower printing plate exchange device 200 is explained with reference to FIG. 12 to FIG. 19. FIG. 12 is a drawing for explaining an exchange step in the upper printing plate exchange device. FIG. 13 is a drawing for explaining the next exchange step of the step in FIG. 12. FIG. 14 is a drawing for explaining the next exchange step of the step in FIG. 13. FIG. 15 is a drawing for explaining the next exchange step of the step in FIG. 14. FIG. 16 a drawing for explaining an exchange step in the lower printing plate exchange device. FIG. 17 is a drawing for explaining the next exchange step of the step in FIG. 16. FIG. 18 is a drawing for explaining the next exchange step of the step in FIG. 17. FIG. 19 is a drawing for explaining the next exchange step of the step in FIG. 18.

Upper Printing Plate Exchange Device

Shift to an Operation Position

In a printing operation, as shown in FIG. 2, the upper printing plate holding device 110 is located in the shelter position by arranging the guide frames 112 and 113 and guide members 114 and 115 in a up-down direction. A downstream side of the stored portion 116*a* is lower than the upstream side of the stored portion 116*a* in the discharge printing plate storing direction. The upstream side of the stored portion is lower than the downstream side of the stored portion in the new printing plate supply direction.

Under the condition, a printing plate 1 of which a tail end is arranged at a lower side is inserted into the stored portion 116*b* between the guide members 114 and 115 of the upper printing plate holding device 110 with the contacting plate 118 so as to store the new printing plate 1 at the stored position.

At the time, a longitudinal direction of the front end portions 121*b* and 122*b* of the support members 121 and 122 of the upper printing plate holding device 110 are positioned toward a straight direction, the hooks 125 and 126 are going out from the stored portions 116*a* and 116*b* by the dead weight so as to overlap on the front end portions 121*b* and 122*b* of the support members 121 and 122. The stored portion 116*b* is positioned at an exterior side with respect to the safety cover 103. A shelter position is located beyond the upper printing portion and the downstream side of the stored portion 116*b* is lower than the downstream of the stored portion 116*b* at the operating position in the printing plate supply direction, so that an operation for the stored portion 116*b* at the shelter position can be operated at the exterior and lower side with respect to the safety cover 103. A new printing plate 1 can be inserted from an opposite side of a contacting plate 118 of the stored portion 116*b*. Therefore, a new printing plate 1 can be set into the stored portion 116*b* simply and easily.

Since almost all members except the stored portions 116*a* and 116*b* of the upper printing plate holding device 110 are stored at an interior side with respect to the safety cover 103, an outwardly protruded volume from the safety cover 103 is small. Therefore, an operation space can be utilized effectively so as to exchange the printing plates conveniently.

When the actuator 130 is contracted as shown in FIG. 12, the upper printing plate holding device 110 is moved to an operation position by turning the guide frames 112 and 113 around the rotational axis 111 so as to arrange the front end of the guide members 114 and 115 toward the upper plate cylinder 12.

A downstream side of the stored portion 116*a* is located higher than an upstream side of the stored portion 116*a* in a discharged printing plate storing direction. That is, an opening portion of the support members 121 and 122 are downwardly inclined. The hooks 125 and 126 are moved so as to advance the claw portion 125*a* and 126*a* into the stored portions 116*a*, 116*b*. Under the condition, the stopper pins 127 and 128 restrict such a movement so that the claw portion 126*a* of the hook 126 can engage a tail end of the new printing plate so as to prevent the new printing plate from falling.

Simultaneously, the support member 121 is moved from a position as shown in FIG. 2 to a front end of the guide frame 112 (upstream side in the discharged printing plate storing direction) as shown in FIG. 12 by actuating the rodless cylinder 119 of the upper printing plate holding device 110. The guiding device 140 is moved to a guiding position by rotating the pivot frame 141 by extending the actuator 143 of the upper first printing plate guiding device 140, then the guide plate 145 for guiding the discharged printing plate 2 discharged from the upper plate cylinder 12 to the stored portion 116*a* of the upper printing plate holding device 110 by rotating the link plate 144 by contracting the actuator 146.

Storing a Discharged Printing Plate

While the press roller 171 is moved to the operation position, the upper printing plate cylinder 12 is pressed and simultaneously rotated along an invert rotational direction so as to disengage the tail end of the printing plates engaged by means for holding the end of the printing plate of the upper plate cylinder 12 so that the tail end of the discharged printing sheet 2 is going out from the upper plate cylinder 12. Then, the discharged printing plate 2 is guided between the guide plates 142 and 145 of the upper first printing plate guide device 140 and fed to the stored portion 116*a* between the guide frames 112 and 113 and the guide member 123 of the upper printing plate holding device 110 by forwarding the tail end. The hook 125 is pivotally supported so that the hook 125 is rotated by the tail end of the discharged printing plate 2 while the tail end is fed. After the tail end of the discharged printing plate 2 is passed through the hook 125, the hook 125 returned to an initial position (as shown in FIG. 12) by the dead weight.

A disengagement of holding the tail end of the printing plate by the means for holding the edge of the printing plate is operated at an upstream point nearer than the edge confronting with the upper plate cylinder 12 of the guide plate 161 in an inverse rotational direction.

By inversely rotating the upper plate cylinder 12, an engaged side of the discharged printing plate 2 is approached to the upper first printing plate guiding device 140. Then, the means for holding the edge of the printing plate disengage the engaged tail end of the printing plate and the press roller 171 is moved to the shelter position so as to be released from the upper plate cylinder 12 and the actuator 152 of the upper first printing plate guide device 140 is shortened. Thereby, the guide roller 149 and the turning plate 150 rotate counter clockwisely around the rotational axis 147. The turning plate 150 moves the engaged end of the discharged printing plate 2 toward an outward radius direction of the upper plate cylinder 12 so that the discharged printing plate 2 can be certainly released from the upper plate cylinder 12.

After the discharged printing plate 2 is completely released from the upper plate cylinder 12, the guide roller 149 and the turning plate 150 are returned to the shelter position by extending the actuator of the first printing press guide device 140. As shown in FIG. 13, the rodless cylinder 119 of the upper printing plate holding device 110 are operated so as to return the support member 121 toward the base end of the guide frame 112 (downstream of the discharged printing plate storing direction), the claw 125*a* of the hook 125 engages the tail end of the discharged printing plate 2 and pulls the discharged printing plate 2 upwardly to the stored position of the stored portion 116*a* formed between the guide frames 112 and 113 and the guide member 123 so as to store the discharged printing plate 2 in the stored position of the stored portion 116*a*.

At that time, the stopper pin 128 restricts the hook 125 rotating toward the upstream side in the discharged printing plate storing direction so that the discharged printing plate 2 can be pulled up certainly. In accordance with the movement of the means for discharging a printing plate with the rodless cylinder 119, the support member 121, the hook 125 and so on, even if the bent engaged end of the discharged printing plate 2 released from the upper plate cylinder 12 is caught by an end at the upper plate cylinder side of the guide plate 161 of the upper second printing plate guide device 160, the engaged end of the discharged printing plate 2 can be easily disengaged form the upper end of the guide plate 161 by rotating the guide roller 162.

Attaching a New Printing Plate

As shown in FIG. 14, the link plate 144 is rotated by extending the actuator 146 of the upper first printing plate guide device 140 so as to move the guide plate 145 to the new printing plate guide position for supplying the new printing plate 1 hold in the stored portion 116*b* of the upper printing plate holding device 110 to the upper plate cylinder 12 and to move the press roller 171 at an operation position so as to press the upper plate cylinder 12. Thus, the support member 122 is moved from the stored position of the stored portion 116*a* to the front end of the guide frame 113 (downstream in the new printing plate supply direction), the press plate 124 contacts with the tail end of the new printing plate 1 and the new printing plate 1 is fed toward the upper plate cylinder 12 (downstream in the new printing plate supply direction).

As described above, the support member 122 is moved toward the front end of the guide frame 113 so as to feed the new printing plate 1 toward the upper printing cylinder 12, the hook 126 is caught and contacted with a catching portion 115*a* of the guide member 115 on the way so as to going out from the stored portion 116*b*. The tail end of the new printing plate 1 is unlocked from the hook 126 so that the new printing plate 1 is fed with positioning the width direction of the new printing plate 1 by the left and right positioning plates 153 of the supper first printing plate guide device 140 and stopped by contacting the engaged end with the press roller 171.

Continuously, the upper plate cylinder 12 is rotated clockwisely, the new printing plate 1 is wound and attached on the upper plate cylinder 12 from the engaged end.

Even if the safety cover 103 is not released, the upper printing plate holding device 110 is moved from the shelter position to the operation position so that the printing plate can be prevented from falling to an inside of the printing portion in an exchange operation.

Switch to the Shelter Position

After feeding the new printing plate 1 as described above, the pivot frame 141 is rotated by contracting the actuator 143 of the upper first printing plate guide device 140 as shown in FIG. 15 so as to move the guide device to the shelter position. And the support member 122 is moved toward the base end of the guide frame 113 by actuating the rodless cylinder 120 of the upper printing plate holding device 110 and the guide frames 112 and 113 are rotated by extending the actuator 130 so as to move the printing plate holding device 110 to the shelter position then the guide frames 112 and 113 and the guide members 114 and 115 are rotated wherein the longitudinal direction thereof is arranged along an up and down direction. A downstream of the stored portion 116*a* is located lower than the upstream of the stored portion 116*a* in the discharged printing plate store direction. The upstream of the stored portion 116*b* is located lower than the downstream of the stored portion 116*b* in the new printing plate supply direction.

The longitudinal direction of the front ends 121*b* and 122*b* of the support members 121 and 122 of the upper printing plate holding device 110 is arranged along a straight direction, the hooks 125 and 126 is rotated by the dead weight so as to go out from the stored portions 116*a* and 116*b* and overlaps the front ends 121*b* and 122*b* of the support members 121 and 122, respectively. Further, the stored portion 116*a* is located at an exterior side with respect to the safety cover 103 and the safety cover 103 is positioned at a back side of the stored discharged printing plate 2 so as to form a guide surface. The shelter position is located beyond the upper printing portion and a position at the downstream of the stored portion 116*b* in the discharged printing plate storing direction is lower than the operation position so that an operation for the stored portion 116*a* in the shelter position can be worked at the lower position at the exterior side of the safety cover 103 protruded form the safety cover 103. The discharged printing plate 2 can be pick up from the stored portion 116*a* at the opposite side of the contacting plate 118, the discharged printing plate 2 can be removed from the stored portion 116*a* without an operator entering into adjacent printing units.

Almost all members of the upper printing holding device 110 expect the stored portions 116*a* and 116*b* are stored at an interior side with respect to the safety cover 103, so that an outwardly protruded volume of the safety cover 103 is small. Thus, a working space can be utilized effectively and a printing plate exchange operation can be improved more conveniently.

Lower Printing Plate Exchange Device

Shift to the Operation Position

In printing, as shown in FIG. 7, the guide frames 212 and 213 and the guide members 214 and 215 of the lower printing plate holding device 210 are arranged along the up and down direction so as to position the stored portions 216*a* and 216*b* at the shelter position which is at an exterior side with respect to the safety cover 203.

Under the condition, the tail end of the new printing plate is positioned at the lower side and inserted into the stored position of the stored portion 216*a* of the lower printing plate holding device by contacting the new printing plate with the contacting plate 218.

The stored portion 216*b* of the lower printing plate holding device 210 is located at the exterior side with respect to the safety cover 203 and the safety cover 203 is arranged along the stored portion 216*b* so that an operation for setting the new printing plate 1 with respect to the stored portion 216*a* at the shelter position can be worked at the exterior side of the safety cover 203 with the protection of the safety cover 203. The new printing plate 1 can be inserted from the opposite side of the contacting plate 218 of the stored portion 216*a* so that the new printing plate 1 can be set in the stored portion 216*b* without an operator entering into adjacent printing units. Thus, the new printing plate 1 can be easily set in the stored portion 216*b*.

Almost all members of the lower printing plate holding device 210 except the stored portions 216*a* and 216*b* are located at an interior side with respect to the safety cover 203, an outwardly protruded volume is small. Thus, working space can be utilized effectively and a printing plate exchange operation can be improved more conveniently.

In the next, when the actuator 230 is contracted, as shown in FIG. 16, the guide frames 212 and 213 and the support frame 217 are rotated around the rotational axis 211 so as to arrange the front end of the guide members 214 and 215 toward the lower plate cylinder 13. Then, the lower printing plate holding device 219 is shifted to the operation position.

Simultaneously, the pick-up member 224 is moved from the position as shown in FIG. 7 to a front end of the guide frame 213 as shown in FIG. 16 by contracting the actuator 220 of the lower printing plate holding device 210. The pivot frame is rotated by extending the actuator 243 of the lower first printing plate guide device 240 so as to move the lower first printing plate guide device 240 at the guiding position. Thus, the link plate 244 is rotated by shortening the actuator 246 so as to move the guide plate 245 to a discharged printing plate guide position for guiding the discharged printing plate 2 discharged from the lower plate cylinder to the stored portion 216*b* of the lower printing plate holding device 210.

Storing a Discharged Printing Plate

The press roller 271 is shifted to the operation position and pressed on the lower plate cylinder 13, while the lower plate cylinder 13 inversely rotated and the engagement of the tail end of the printing plate 2 with the means for holding the edge of the printing plate of the lower plate cylinder 13 is released. Thus, the tail end of the discharged printing plate 2 is going out from the lower plate cylinder 13, the discharged printing plate 2 is guided between the guide plates 242 and 245 of the lower first printing plate guide device 240. The discharged printing plate 2 is fed on the pick-up member 224 of the stored portion 216*b* between the guide frames 214 and 215 of the lower printing plate holding device 210 from the tail end.

The disengagement of the tail end of the printing plate by the means for holding the tail end of the printing plate is operated at an upstream portion with respect to an end portion confronting with the lower plate cylinder 13 of the guide plate 261 in a inverse rotational direction of the lower plate cylinder 13.

While the plate cylinder 13 is rotated inversely, the engaged side of the discharged printing plate 2 is approached to the lower first printing plate guide device 240. Then, the engagement of the engaged end of the printing plate by the means for holding the edge of the printing plate is disengaged and the press roller 271 is shifted to the shelter position for removed from the lower plate cylinder 13 and the actuator 252 of the lower first printing plate guide device 240 is contracted. Thereby, the guide roller 249 and the turning plate 250 rotate counter clockwise around the rotational axis 247 as shown in FIG. 16, the turning plate 250 feeds the engaged end of the discharged printing plate 2 toward an outward radius direction of the lower plate cylinder 13 so that the bent engaged end of the discharged printing plate 2 can be certainly disengage.

After completely disengaging the discharged printing plate 2 from the lower plate cylinder 13, the guide rollers 249 and the turning plate 250 are returned to the shelter position by extending the actuator 252 of the lower first printing plate guide device 240. As shown in FIG. 17, the pick-up member 225 is returned to the base end of the guide frame 213 by actuating the actuator 220 of the lower printing plate holding device 210. In accordance with such a movement, the discharged printing plate 2 is moved to the stored position of the stored portion 216*b* on the pick-up member 224 between the guide members 214 and 215 and stored in the stored position of the stored portion 216*b* while the pick-up member 224 engages with the tail end of the discharged printing plate 2.

In accordance with such a movement of the discharge means with the actuator 220 and the pick-up member 224, even if the bent engaged end of the discharged printing plate 2 disengaged from the lower plate cylinder 13 is caught by the end at the lower plate cylinder side of the guide plate 261 of the lower second printing plate guide device 260, the engaged end of the discharged printing plate 2 can be easily disengaged from the end portion of the guide plate 261 by rotating the guide roller 262.

Attachment of the New Printing Plate

As shown in FIG. 18, the link plate 244 is rotated by extending the actuator 246 of the lower first printing plate guide device 240 so as to move the guide plate 245 to the new printing plate guide device for supplying the new printing plate 1 hold in the stored portion 216*a* of the lower printing plate holding device 210 to the lower plate cylinder 12. And the press roller 271 is shifted to the operation position so as to press the lower plate cylinder 13. The extrusion member 223 is moved to the front end of the guide frame 212 by contracting the actuator 219 of the lower printing plate holding device 210, the tail end of the new printing plate 1 is pushed by the pushing member 223 and fed toward the lower printing plate cylinder 13 while the width direction of the new printing plate 1 is accurately adjusted by the left- and right-positioning plates 252.

When the engaged end of the new printing plate 1 contacts with the press roller 171, the feeding operation is stopped once. By rotating the upper plate cylinder 12 counter clockwise, the new printing plate 1 is wound and attached to the upper plate cylinder 12 from the engaged end.

At that time, although the safety cover 203 is not released, the lower printing plate holding device 210 can be shifted from the shelter position to the operation position so that tools can be prevented from falling into an internal portion of the printing portion in exchanging a printing plate exchange operation.

Shift to a Shelter Position

After feeding the new printing plate 1 as described above, the pivot frame is rotated by contracting the actuator 243 of the lower first printing plate guide device 240 of the actuator 243 so as to move the guide device 240 to the shelter position. The extrusion member 223 is moved toward the base end of the guide frame 212 by extending the actuator 219 of the lower printing plate holding device 210. The guide frames 212 and 213 are rotated by contracting the actuator 230 so as to move the printing plate holding device 210 to the shelter position. Thus, each component such as the guide frames 212 and 213 pass through the safety covers 202 and 203 and the opening portions 202*a*, 202*b*, 203*a* and 203*b* and the slit 203*c* and are stored at an interior side of the safety covers 202 and 203.

At that time, the stored portion 216*b* of the lower printing plate holding device 210 is positioned at an exterior side with respect to the safety cover 203, an operation for the stored portion 216*b* at the shelter position can be worked at the exterior side with respect to the safety cover 203. The discharged printing plate 2 can be pick up from the stored portion 216*b* at an opposite side of the contacting plate 218, so that the discharged printing plate 2 can be removed from the stored portion 216*b* without an operator entering into adjacent printing units. The discharged printing plate 2 can be picked up from the stored portion very easily.

Almost all members of the lower printing plate holding device 210 except the stored portions 216*a* and 216*b* are stored at an interior side with respect to the safety cover 203, so that an outward protruded volume of the safety cover 203 is small. Thus, a working space can be utilized effectively and the printing plates can be exchanged more conveniently.

Figure 20:
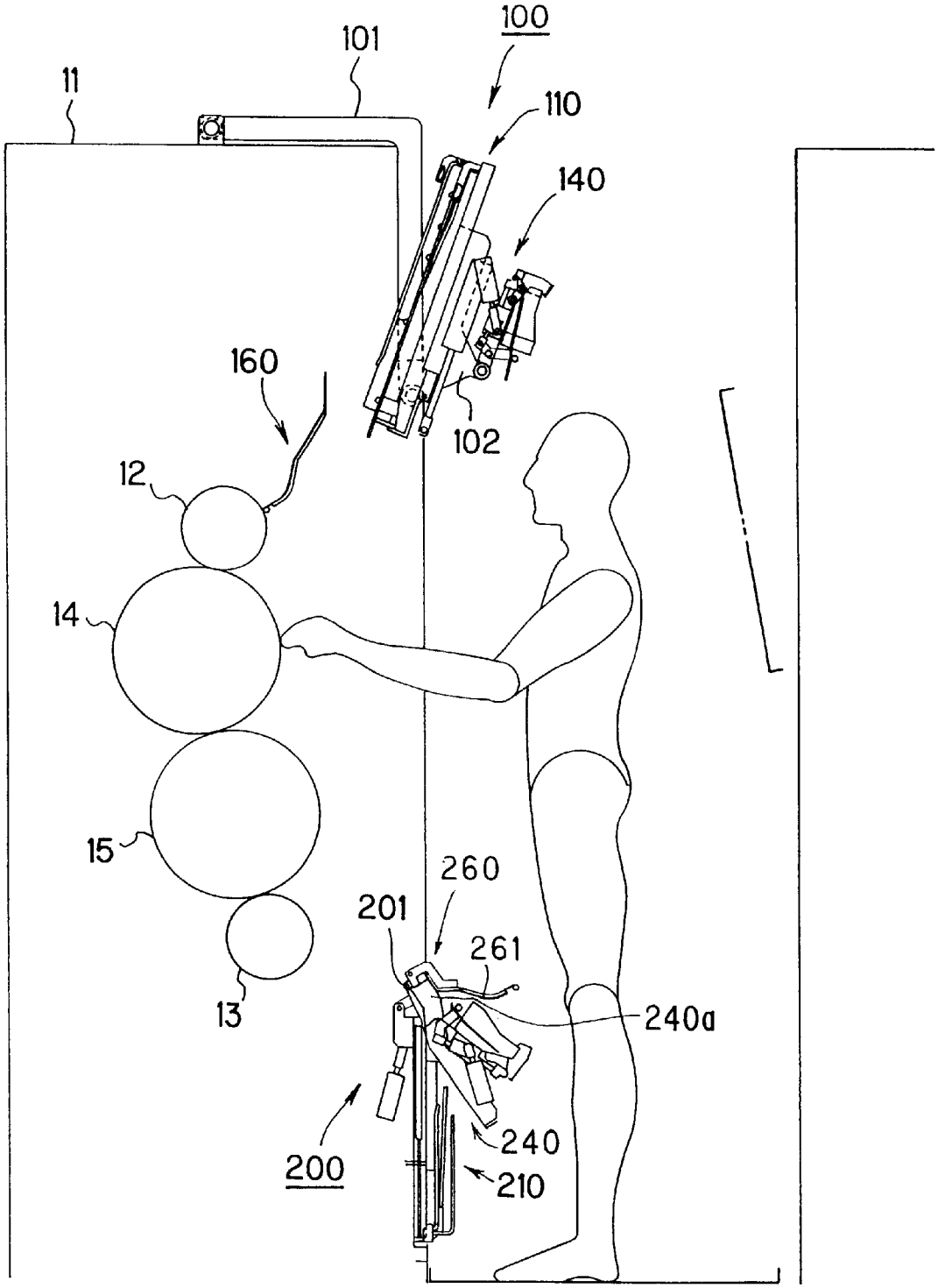
FIG. 20 explains a maintenance operation to inspect a surrounding portion of a rubber cylinder and a plate cylinder.

Maintenance of Rubber Cylinder and Surrounding Portion of the Plate Cylinder In the case of inspecting a surrounding portion of the plate cylinders 12 and 13 and the rubber cylinders 14 and 15, the safety cover 103 is opened as shown in FIG. 20. Then, the support frame 102 integrally supported with the safety cover 103 is rotated around the support arm 101. The upper printing plate holding device 110 and the upper first printing plate guide device 140 are pulled from the frame 11. On the other hand, the support frame 240*a* of the lower first printing plate guide device 240 and the guide plate 261 of the lower second printing plate guide device 260 are rotated around the support axis 201, the lower first printing plate guide device 240 and the lower second printing plate guide device 260 are pulled from the frame 11 of the printing unit. Thereby, the surrounding portions of the plate cylinders 12 and 13 and the rubber cylinders 14 and 15 of the printing portion in the printing unit can be released simultaneously with providing the working space at the surrounding portions of the plate cylinders 12 and 13 and the rubber cylinders 14 and 15 so as to be inspected easily.

Figure 21:
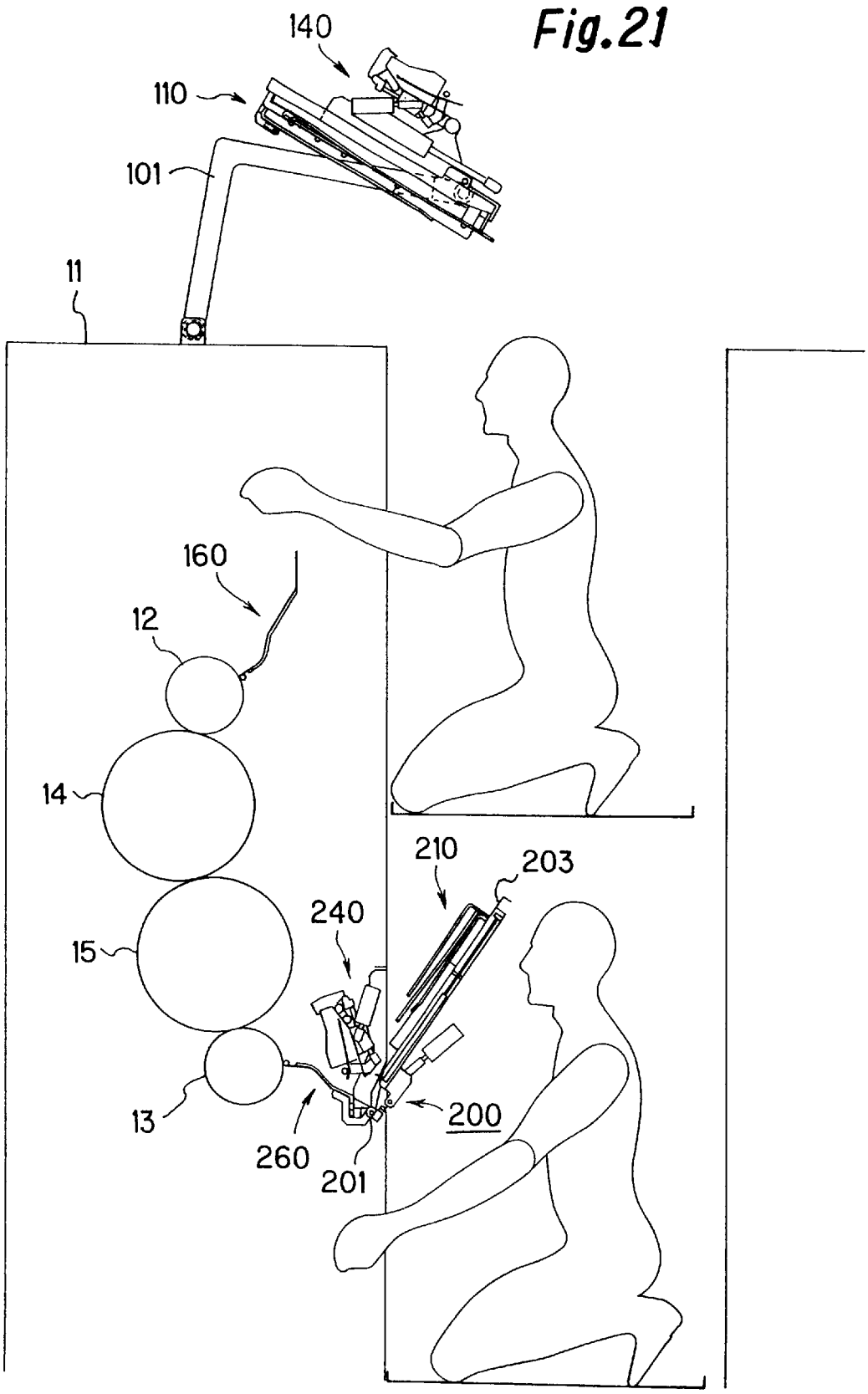
FIG. 21 explains a maintenance operation to inspect to a surrounding portion of an ink supply device.

Inspection of the Surrounding Portion of the Ink Supply Device and a Water Supply Device In the case of inspecting the surrounding portion of the ink supply device and the water supply device (portion above the upper plate cylinder 12, portion beyond the lower plate cylinder 13), the support arm 101 of the upper printing plate exchange device 100 is rotated by the frame 11 of the printing unit from a position as described above as shown in FIG. 21, the upper printing plate holding device 110 and the upper first printing plate guide device 140 are located above the frame 11 of the printing unit, the lower printing plate holding device 210 with the safety cover 203 is pulled out from the printing unit by rotating the safety cover 203 of the lower printing plate exchange device 200 around the support axis 201. Thereby, the surrounding portion of the ink supply device and the water supply device of the printing portion of the printing unit can be released simultaneously providing a working space at the surrounding portion of the ink supply device and the water supply device so as to be inspected easily.

Accordingly, the above described upper printing plate exchange device 100 and lower printing plate exchange device 200 can obtain the following effects.

(1) Only the upper printing plate holding device 110 of the upper printing plate exchange device 100 is shifted to an operation position, the claw portions 125*a* and 126*a* of the hooks 125 and 126 are advanced in the stored portions 116*a* and 116*b*. Only the upper printing plate holding device 110 is shifted to the shelter position, the claw portions 125*a* and 126*b* of the hooks 125 and 126 are going out from the stored portions 116*a* and 116*b*, an insertion of the new printing plate 1 into the stored portion 116*b* and the pick-up the discharged printing plate 2 from the stored portion 116*a* can be operated very easily without providing driving means for rotating the hooks 125 and 126. Therefore, although the structure is simple, the pick-up of the discharged printing plate 2 and the set of the new printing plate 1 can be operated easily.

(2) At the shelter position, the downstream of the stored portion 116*a* of the upper printing plate holding device 110 of the upper printing plate exchange device 100 is located lower than the upstream of the stored portion 106*b* in the discharged printing plate storing direction, on the other hand, the upstream of the stored portion 116*b* is located lower than the downstream of the stored portion 116*b* in the new printing plate supplying direction. At the operation position, the downstream of the stored portion 116*a* of the upper printing holding device 110 of the upper printing plate exchange device 100 is located higher than the upstream of the stored portion 116*a* in the discharged printing plate storing direction and the upper stream of the stored portion 116*b* is located higher than the downstream of the stored portion 116*b* in the new printing plate supplying direction so that the stored portions 116*a* and 116*b* at the shelter position can be found a space at the lower level. Thereby, although the printing portion is located at a relatively high level, the printing plate 1 can be set easily and the discharged printing plate 2 can be picked up easily.

(3) Since the stored portions 116*a* and 116*b* of the upper printing holding device 110 of the upper printing exchanging device 100 at the shelter position are located beyond the upper printing portion, the new printing plate 1 can be set easily and the discharged printing plate 2 can be picked up easily even if the upper printing portion is located at the relatively high level.

(4) The stored portions 116*a* and 116*b* of the upper printing plate holding device 110 of the upper printing plate exchange device 100 at the shelter position are located at the exterior side with respect to the safety cover 103, so that the new printing plate 1 and the discharged printing plate 2 can be set and discharged without releasing the safety cover 103.

(5) Since the guide rollers 162 and 262 are provided at the end of the guide plates 161 and 261 of the second printing plate guiding devices 160 and 260 at the side of the plate cylinders 12 and 13, the discharged printing plate 2 can be certainly disengaged from the end of the guide plates 161 and 261 although the bent end portion of the discharged printing portion 2 is caught. Although the discharged printing plate 2 is automatically discharged, the discharged printing plate 2 can be discharged certainly and the discharged printing plate 2 and the devices can prevent from being damaged.

(6) Rotational axes of the lower first and second printing plate guide devices 240 and 260 and the safety cover 203 are equal, so that a working space can be released by rotating these devices. Although the sufficient space can not be prepared above the frame 11, the working space can be certainly prepared at a portion surrounding with the plate cylinder 13 without adding extra components.

(7) In order to move the stored portions 216*a* and 216*b* to the shelter position located at an exterior side with respect to the safety cover 203 and the operation position for connecting to the lower first printing plate guiding device 240 located in the guide position, the lower printing plate holding device 210 is pivotally provided at the cover 203 so that the new printing plate 1 and the discharged printing plate can be set and picked up easily at the exterior side with respect to the safety cover 203.

(8) The guide plates 145 and 245 of the fist printing plate guide devices 140 and 240 guide the discharged printing pale 2 to the stored portion 116*a* and 216*b* of the printing plate holding device 110 and 210. The new printing plate 1 from the stored portions 116*b* and 216*b* are guided to the plate cylinders 12 and 13 so that the new printing plate 1 and the discharged printing plate 2 can be straggled certainly.

(9) Without releasing the safety covers 103 and 203, the new printing plate 1 can be supplied and the discharged printing plate 2 can be stored by shifting the printing plate holding devices 110 and 210 from the shelter position to the operation position. During the printing plates exchanged, the safety covers 103 and 203 are located at a closed position so that the tools can be prevented from falling into the frame 11.

(10) The printing plate holding device 110 and 210 are held with respect to the safety covers 103 and 203, the printing holding device 110 and 210 can be released from the plate cylinders 12 and 13 simultaneously with closing/opening the safety covers 103 and 203. The inspection effect can be improved.

(11) Almost all members of the printing plate holding devices 110 and 210 at the shelter position except the stored portions 116*a*, 116*b*, 216*a* and 216*b* can be stored at an interior side with respect to the safety covers 103 and 203, so that an outward protruded volume of the safety covers 103 and 203 is small. The working space can be utilized effectively and the printing plate exchange operation can become more conveniently.

(12) When the discharged printing plate 2 is picked up from the stored portion 116*a* of the printing plate holding plate 110 or the new printing plate 1 is set to the stored portion 216*b* of the lower printing plate holding device 210, the safety covers 103 and 203 can be used as the guide surface so that setting the new printing plate 1 and picking up the discharged printing plate 2 can be operated easily with the simple members. The manufacturing cost can be reduced.

(13) Since the maximum rotational radius of the safety covers 103 and 203 is shorter than the maximum rotational radius of the printing plate holding device 110 and 210, the safety covers 103 and 203 can be closed and opened easily without an operator crashing on the safety covers 103 and 203 during the inspection.

Figure 22A:
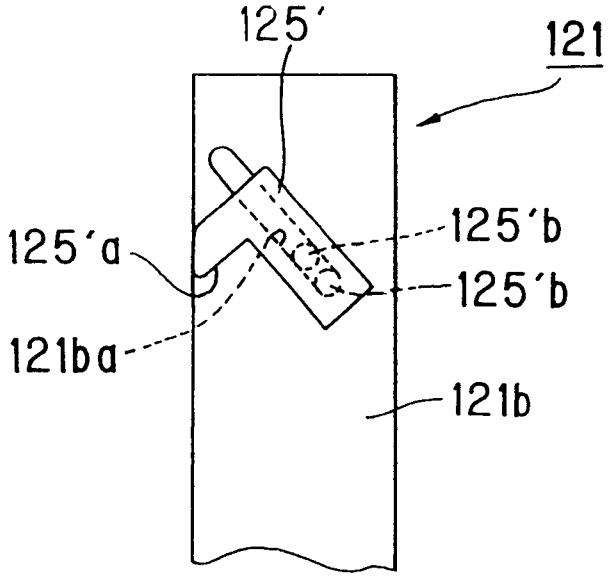
FIG. 22A is enlarged view of an essential part of another embodiment of a printing plate holding device according to the present invention.
Figure 22B:
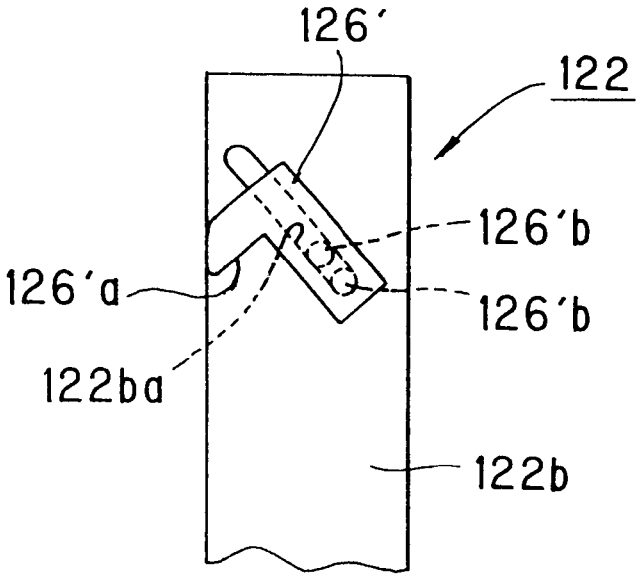
FIG. 22B is enlarged view of an essential part of another embodiment of a printing plate holding device according to the present invention.

In the present embodiment, although the hooks 125 and 126 are pivotally provided at the front ends 121*b* and 122*b* of the support members 121 and 122, as shown in FIGS. 22A and 22B, instead of the hooks 125 and 126, it may be provided hooks 125' and 126' capable of sliding, via paired pins 125'*b* and 126'*b* in a pair of slide grooves 121*ba* and 122*b* a formed at the front end portion 121*b* and 122*b* of the support members 121 and 122, respectively.

Figure 23A:
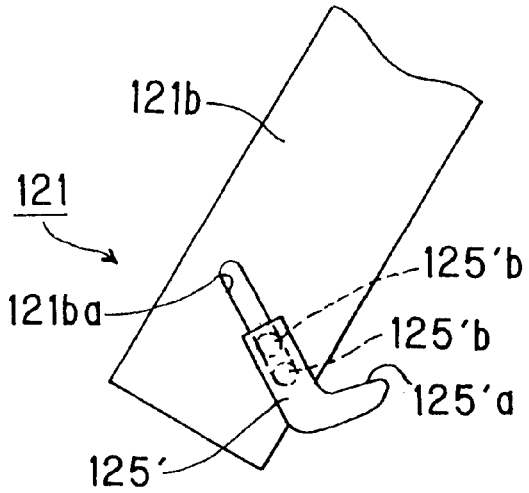
FIG. 23A and FIG. 23B explain an operation as shown in FIG. 22A.
Figure 24A:
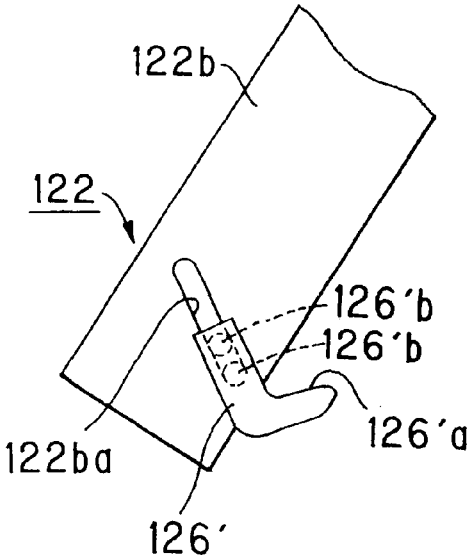
FIG. 24A and FIG. 24B explains an operation as shown in FIG. 22B.
Figure 24B:
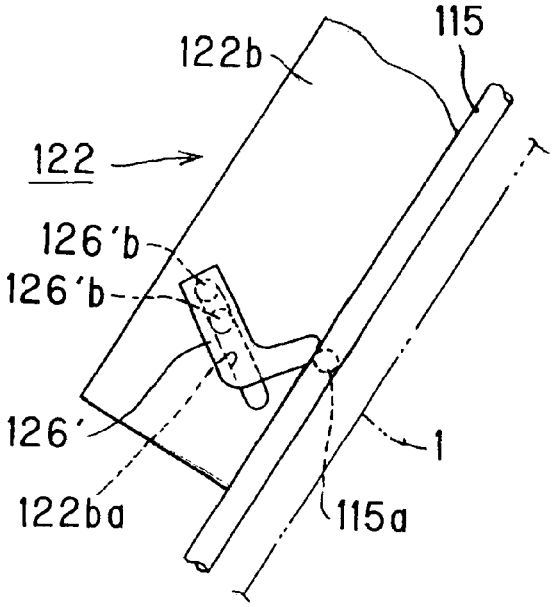

Regarding the hooks 125' and 126', when the upper printing plate holding device 110 is switched to the operation position, the hooks 125' and 126' are slid by the dead weight so as to advance the claw portions 125'*a* and 126'*a* in the stored portions 116, 116*b* (see FIG. 23A, FIG. 24B).

Figure 23B:
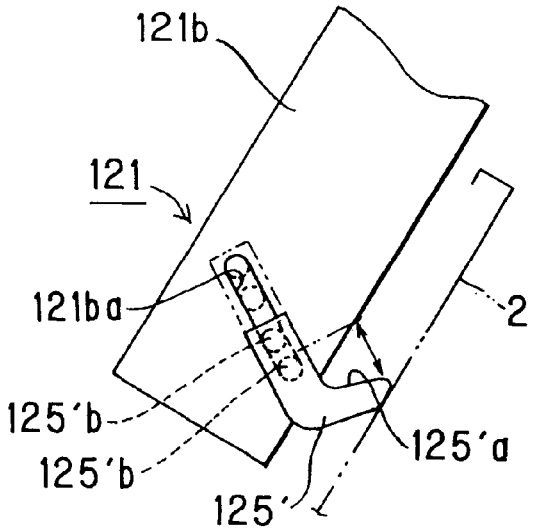

Regarding the hook 125' advanced in the stored portion 116*a*, the hook 125' is pushed by the tail end of the discharged printing plate 2 so as to go out from the stored portion 116*a* by feeding the discharged printing plate 2. At that time when the tail end of the discharged printing plate 2 passes, the hook 125' can slide into the stored portion 116*a* again by dead weight (see FIG. 23B). Regarding the hook 126' advanced in the stored portion 116*b*, the hook 126' is caught by the hooking member 115*a* of the guide member 115 on the way, the hook 126' can be slid so as to go out from the stored portion 116*b* (see FIG. 24B).

In the embodiment according to the present invention, although the hook 126 can be gone out from the stored portion 116*b* by contacting with the hooking member 115*a* of the guide member 115, instead of the hooking portion 115*a*, the hook 126 can be caught by a magnet member so that the hook 126 can be gone out from the stored portion 116*b* by moving the hook 126.

In accordance with a printing press according to the present invention, a device for holding a printing plate is advanced to a storing space by moving storing means for storing the printing plate to an operation position of the storing means and the printing plate holding member is released from the storing space to a shelter position of the storing means, so that it is unnecessary to provide an exclusive use driving device for driving the printing plate holding member, a number of parts and a manufacturing cost can be decreased and the printing plate can be picked up easily.

What is claimed is:

1. A printing press comprising:

a pair of left and right frames, a cover movably supported between a closing position for closing at least one part of a space formed between said pair of left and right frames and a releasing position for releasing said space, means for holding a printing plate, the means for holding is swingably supported and movably supported between a shelter position, at the shelter position the means for holding extends downward from a swing center, for holding a new printing plate supplied to a plate cylinder or holding a discharged printing plate discharged from said plate cylinder and an operation position for supplying said new printing plate to said plate cylinder or storing said discharged printing plate discharged from said plate cylinder, said means for holding the printing plate located at an exterior side with respect to said cover, the cover extends downward from the swing center of the means for holding, wherein said means for holding a printing plate can be moved between said shelter position and said operation position while said cover is located at said closing position.

2. A printing press as claimed in claim 1, wherein said means for holding a printing plate is supported at a side of said cover.

3. A printing press as claimed in claim 1, wherein said cover is swingably supported at a side of said frames.

4. A printing press as claimed in claim 1, wherein said cover is swingably supported at a side of the support member swingably supported at a side of said frames.

5. A printing press comprising:

a pair of left and right frames, a cover movably supported between a closing position for closing at least one part of a space formed between said pair of left and right frames and a releasing position for releasing said space, means for holding a printing plate, the means for holding is swingably supported and movably supported between a shelter position for holding a new printing plate supplied to a plate cylinder or holding a discharged printing plate discharged from said plate cylinder, at the shelter position the holding means extends in substantially the same direction as that in which the cover extends from a swing center of the holding means and an operation position for supplying said new printing plate to said plate cylinder or storing said discharged printing plate discharged from said plate cylinder, said means for holding the printing plate are located at an exterior side with respect to said cover, said means for holding a printing plate can be moved between said shelter position and said operation position while said cover is located at said closing position, said means for holding a printing plate includes:

a first guide member for supporting one side surface of said printing plate and a second guide member for supporting the opposite surface of said printing plate, said cover comprises an opening portion corresponding to one of said first and second guide members, wherein the cover has an opening portion at a position which corresponds to either the first guide member or the second guide member which is located on the cover side at the shelter position of the printing plate holding means.

6. A printing press as claimed in claim 5, wherein said means for holding a printing plate is supported at a side of said cover.

7. A printing press as claimed in claim 5, wherein said cover is swingably supported at a side of said frames.

8. A printing press as claimed in claim 5, wherein said cover is swingably supported at a side of the support member swingably supported at a side of said frames.

9. The printing press as claimed in claim 5, wherein the cover surface of the cover is located substantially in the same plane as that of the guide surface of either the first guide member or the second guide member, which is located on the cover side at the shelter position of the printing plate holding means.

10. A printing press comprising:

a pair of left and right frames, a cover movably supported between a closing position for closing at least one part of a space formed between said pair of left and right frames and a releasing position for releasing said space, means for holding a printing plate, the means for holding is swingably supported and movably supported between a shelter position for holding a new printing plate supplied to a plate cylinder or holding a discharged printing plate discharged from said plate cylinder, at the shelter position the holding means extends in substantially the same direction as that in which the cover extends from a swing center of the holding means and an operation position for supplying said new printing plate to said plate cylinder or storing said discharged printing plate discharged from said plate cylinder, said means for holding the printing plate located at an exterior side with respect to said cover, said means for holding a printing plate can be moved between said shelter position and said operation position while said cover is located at said closing position, said means for holding a printing plate includes:

a first guide member for supporting one side surface of said printing plate and a second guide member for supporting the opposite surface of said printing plate, and a plurality of separated covers are arranged along the axial direction of the plate cylinder in such a manner that each of the covers faces, with corresponding clearances, either the first guide member or the second guide member, which is located on the cover side at the shelter position of the printing plate holding means.

11. A printing press as claimed in claim 10, wherein said means for holding a printing plate is supported at a side of said cover.

12. A printing press as claimed in claim 10, wherein said cover is swingably supported at a side of said frames.

13. A printing press as claimed in claim 10, wherein said cover is swingably supported at a side of the support member swingably supported at a side of said frames.

14. The printing press as claimed in claim 10, wherein the cover surface of the cover is located substantially in the same plane as that of the guide surface of either the first member or the second guide member, which is located on the cover side at the shelter position of the printing plate holding means.

15. A printing press comprising:

a pair of left and right frames, a cover movably supported between a closing position for closing at least one part of a space formed between said pair of left and right frames and a releasing position for releasing said space, means for holding a printing plate having a swing c enter and movably supported between a shelter position for holding a new printing plate supplied to a plate cylinder or holding a discharged printing plate discharged from said plate cylinder and an operation position for supplying said new printing plate to said plate cylinder or storing said discharged printing plate discharged from said plate cylinder, said means for holding the printing plate located at an exterior side with respect to said cover, at said shelter position the holding means and the cover extend in substantially the same direction from the swing center, wherein said means for holding a printing plate can be moved between said shelter position and said operation position while said cover is located at said closing position, wherein said cover is swingably supported at a side of the frames, said means for holding a printing plate swingably supported at the both sides of said cover in an axial direction of said p late cylinder and the maximum oscillating radius of said cover within said means for holding said printing plate is shorter than the maximum oscillating radius of said means for holding said printing plate.

* * * * *